US006116719A

United States Patent [19]

Maza

[11] Patent Number: 6,116,719

[45] Date of Patent: Sep. 12, 2000

[54] REMOVABLE PRINTHEAD SERVICING MODULE WITH REMOTE PRIMER VACUUM SOURCE

[75] Inventor: Jesus Garcia Maza, Terrassa, Spain

[73] Assignee: Hewlett-Packard Company, Palo Alto, Calif.

[21] Appl. No.: 09/032,217

[22] Filed: Feb. 27, 1998

Related U.S. Application Data

[63] Continuation-in-part of application No. 08/811,405, Mar. 4, 1997.

[51] Int. Cl.[7] ..... B41J 2/165

[52] U.S. Cl. ..... 347/22; 347/30

[58] Field of Search ..... 347/33, 22, 30, 347/29, 35, 49, 24, 72

[56] References Cited

U.S. PATENT DOCUMENTS

| | | | |
|---|---|---|---|
| 5,185,614 | 2/1993 | Courian et al. | 347/30 |
| 5,420,619 | 5/1995 | Glassett et al. | 347/30 |
| 5,434,605 | 7/1995 | Osborne | 347/30 |
| 5,450,105 | 9/1995 | Dangelo | 347/30 |
| 5,621,441 | 4/1997 | Waschhauser et al. | 347/30 |
| 5,638,099 | 6/1997 | Nguyen et al. | 347/30 |
| 5,644,346 | 7/1997 | Schwiebert et al. | 347/30 |
| 5,793,389 | 8/1998 | Mitchell | 347/28 |
| 5,850,239 | 12/1998 | Gentile | 347/30 |

FOREIGN PATENT DOCUMENTS

| | | | |
|---|---|---|---|
| 0736387 | 12/1998 | European Pat. Off. . | |
| 6-234209 | 8/1994 | Japan | 347/22 |

*Primary Examiner*—N. Le
*Assistant Examiner*—Thien Tran

[57] ABSTRACT

A manually removable service module is provided for use with an inkjet printer having a service zone for printhead servicing functions including printhead priming. The service module comprises a nozzle plate cap for interfacing with a nozzle plate of a printhead to perform priming functions, a primer port for connecting the service module to a primer located within the printer, and a path through the service module between the interfacing cap and the primer port. The primer port is automatically connected to the primer as the service module is inserted into the printer by a user of the printer. In a embodiment there is also provided an ink separation chamber having a plurality of baffle walls within the service module so as to prevent ink from contaminating the primer port.

23 Claims, 23 Drawing Sheets

FIG. 6
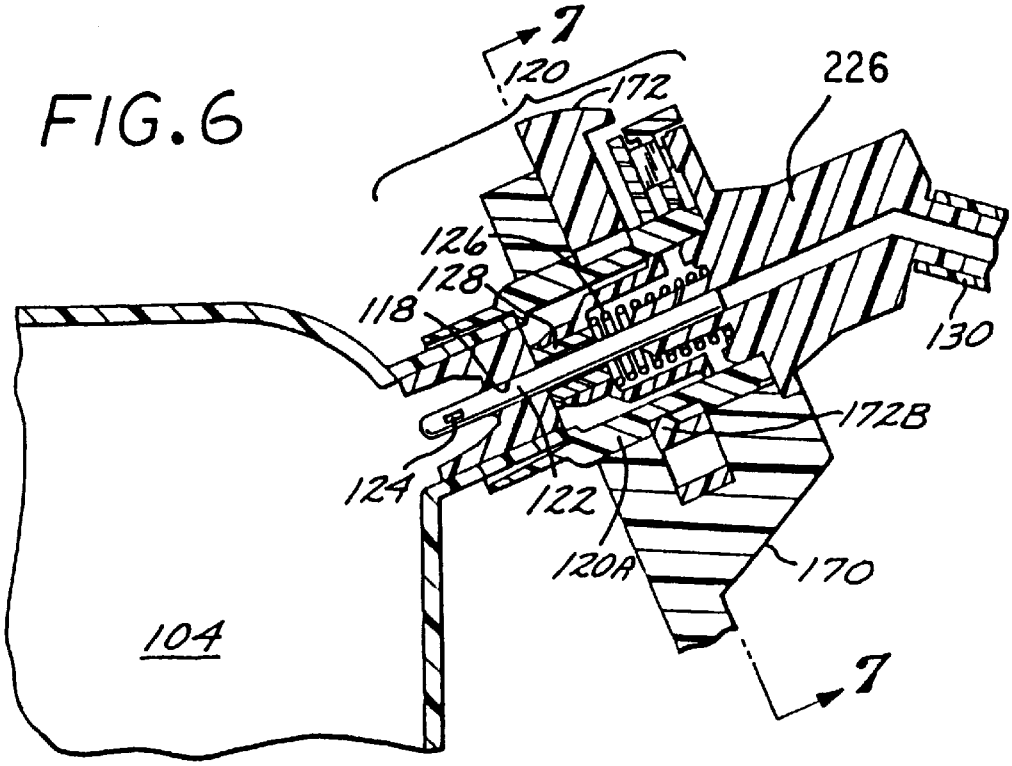
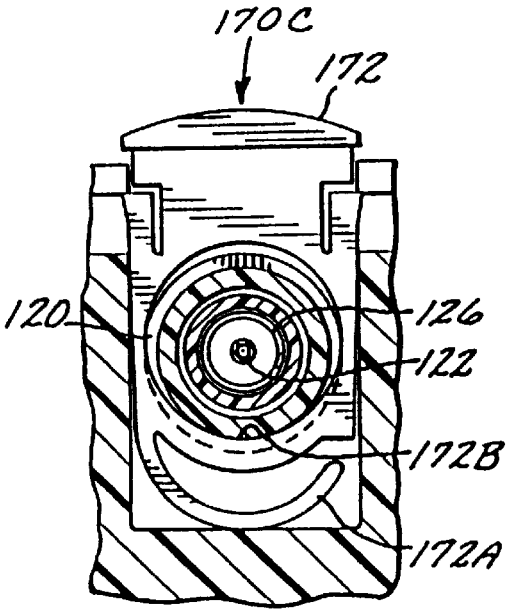
FIG. 7
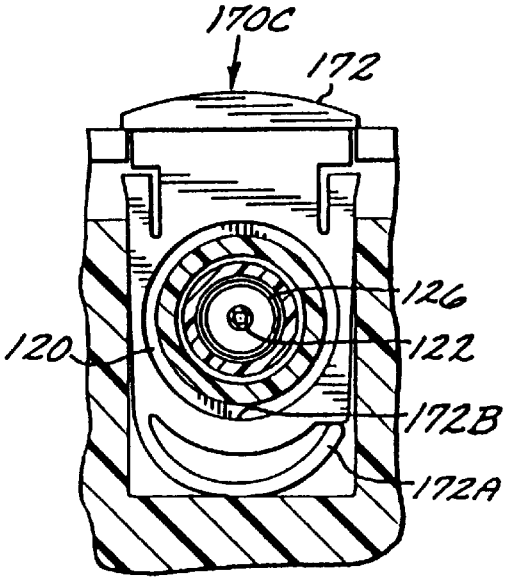
FIG. 8

REMOVABLE PRINTHEAD SERVICING MODULE WITH REMOTE PRIMER VACUUM SOURCE

CROSS-REFERENCE TO RELATED APPLICATIONS

The present invention is a continuation-in-part application of application U.S. Ser. No. 08/811,405 filed Mar. 4, 1997 by Brian Canfield et al entitled MANUALLY REPLACEABLE PRINTHEAD SERVICING MODULE FOR EACH DIFFERENT INKJET PRINTHEAD which application is incorporated herein by reference.

A previously filed commonly assigned application related this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, now U.S. Pat. No. 5,745,137, which is incorporated herein by reference.

Other more recent commonly assigned related applications are Ser. No. 08/726,587 entitled INKJET CARTRIDGE FILL PORT ADAPTOR filed Oct. 7, 1996 by Max S. Gunther, et al., U.S. Pat. No. 5,874,976; Ser. No. 08/810,485 entitled INKJET PRINTING WITH REPLACEABLE SET OF INK-RELATED COMPONENTS etc. filed Mar. 3, 1997 by Rick Becker, et al., now U.S. Pat. No. 5,929,883 Ser. No. 08/805,859 entitled REPLACEABLE INK SUPPLY MODULE (BAG/BOX/TUBE/VALVE) etc. filed Mar. 3, 1997 by Elizabeth Zapata, et al.; Ser. No. 08/810,840 entitled SPACE EFFICIENT ENCLOSURE SHAPE FOR NESTING TOGETHER A PLURALITY OF REPLACEABLE INK SUPPLY BAGS filed Mar. 3, 1997 by Erich Coiner, et al.; Ser. No. 08/810,840 entitled PRINTING SYSTEM WITH SINGLE ON/OFF CONTROL VALVE etc. filed Mar. 3, 1997 by Max S. Gunther, et al; Ser. No. 08/805,861 entitled APPARATUS FOR PERIODIC AUTOMATED CONNECTION OF INK SUPPLY VALVES etc. filed Mar. 3, 1997 by Ignacio Olazabal, et al.; and Ser. No. 08/806,749 entitled VARIABLE PRESSURE CONTROL FOR INK REPLENISHMENT etc. filed Mar. 3, 1997 by Mark now U.S. patent all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" now U.S. Pat. No. 5,745,137 which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications described certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

A manually removable service module is provided for use with an inkjet printer having a service zone for printhead servicing functions including printhead priming. The service module comprises means (preferable a nozzle plate cap) for interfacing with a nozzle plate of a printhead to perform priming functions, a primer port for connecting the service module to a primer located within the printer, and a path through the service module between the interfacing means and the primer port. The primer port is automatically connected to the primer as the service module is inserted into the printer by a user of the printer. In a embodiment there is also provided an ink separation chamber having a plurality of baffle walls within the service module so as to prevent ink from contaminating the primer port.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
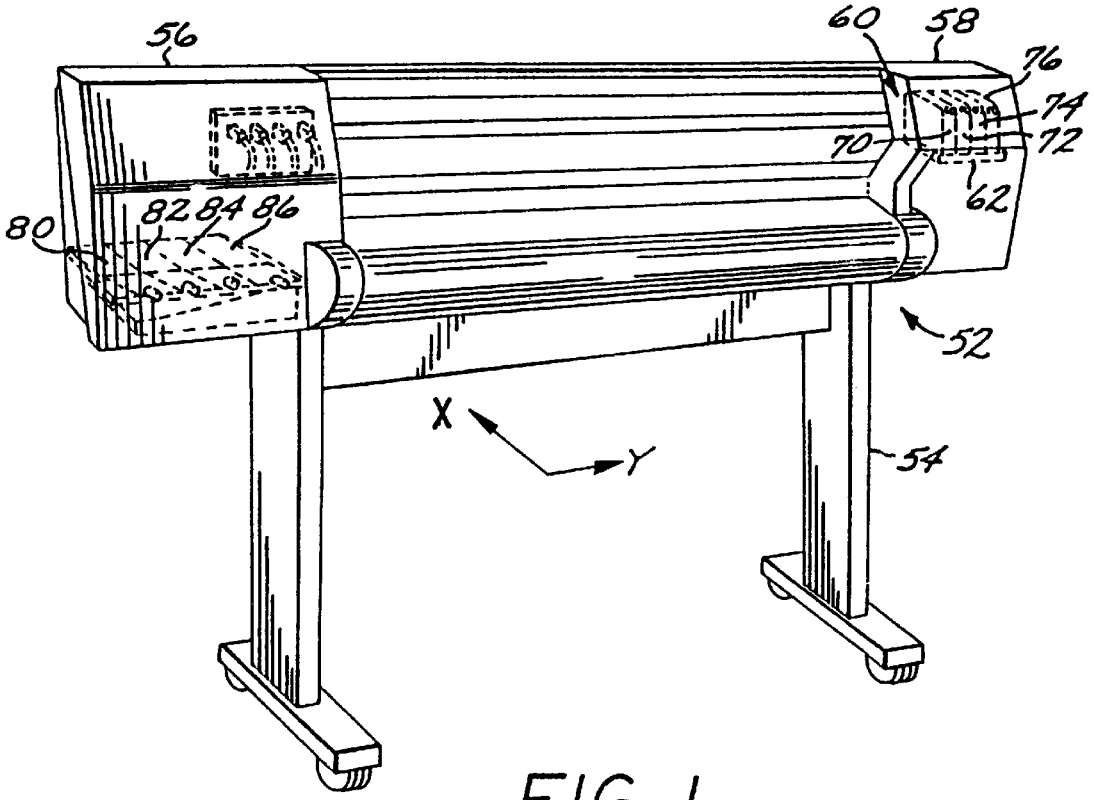
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a vertical or media axis by a media axis drive mechanism (not shown). As is common the art, the media drive axis is denoted as the 'x' axis and the carriage scan axis is denoted as the 'y' axis.

Figure 3:
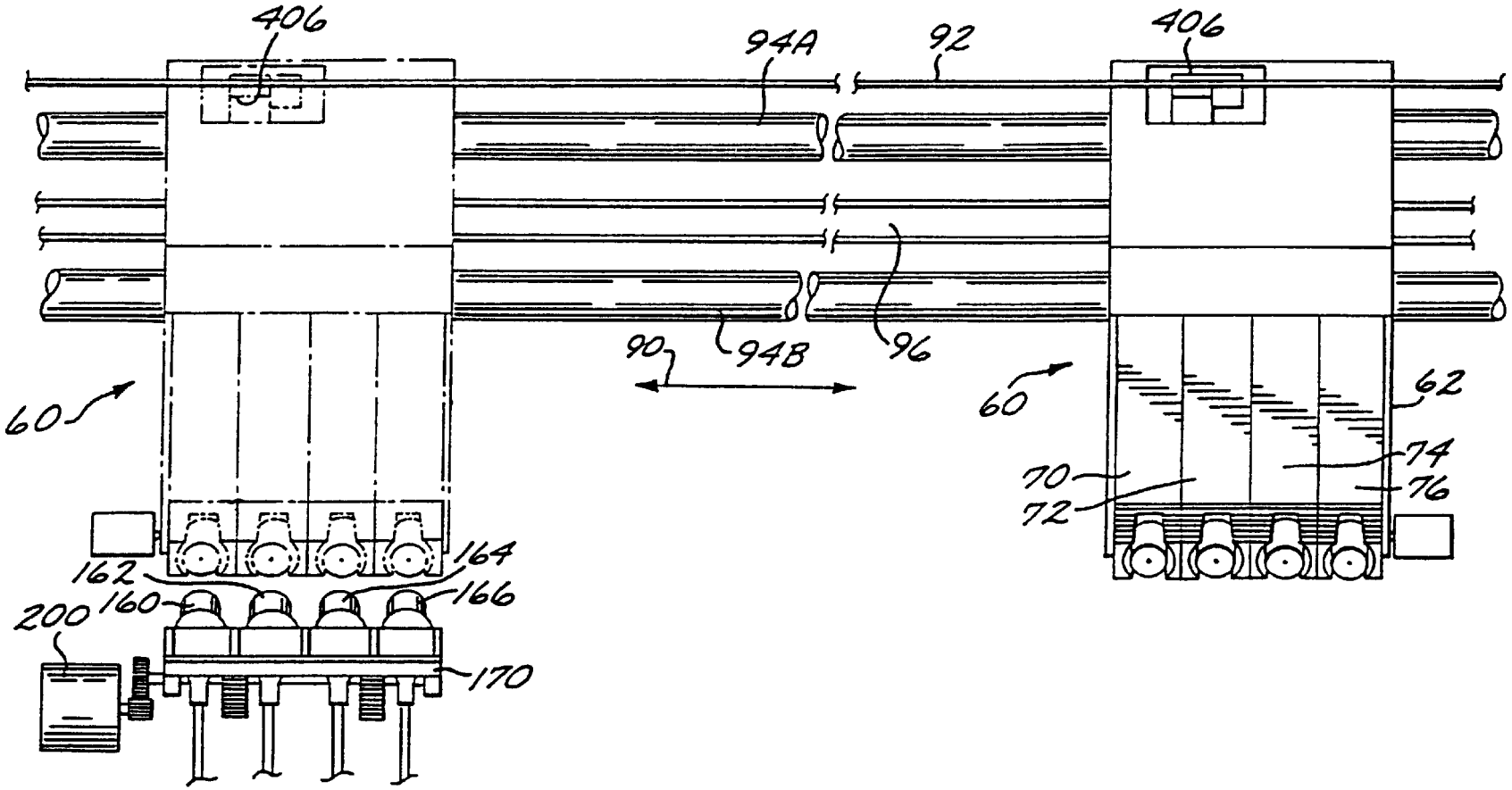
FIG. 3 is a top view showing the printer carriage and refill station.
Figure 4:
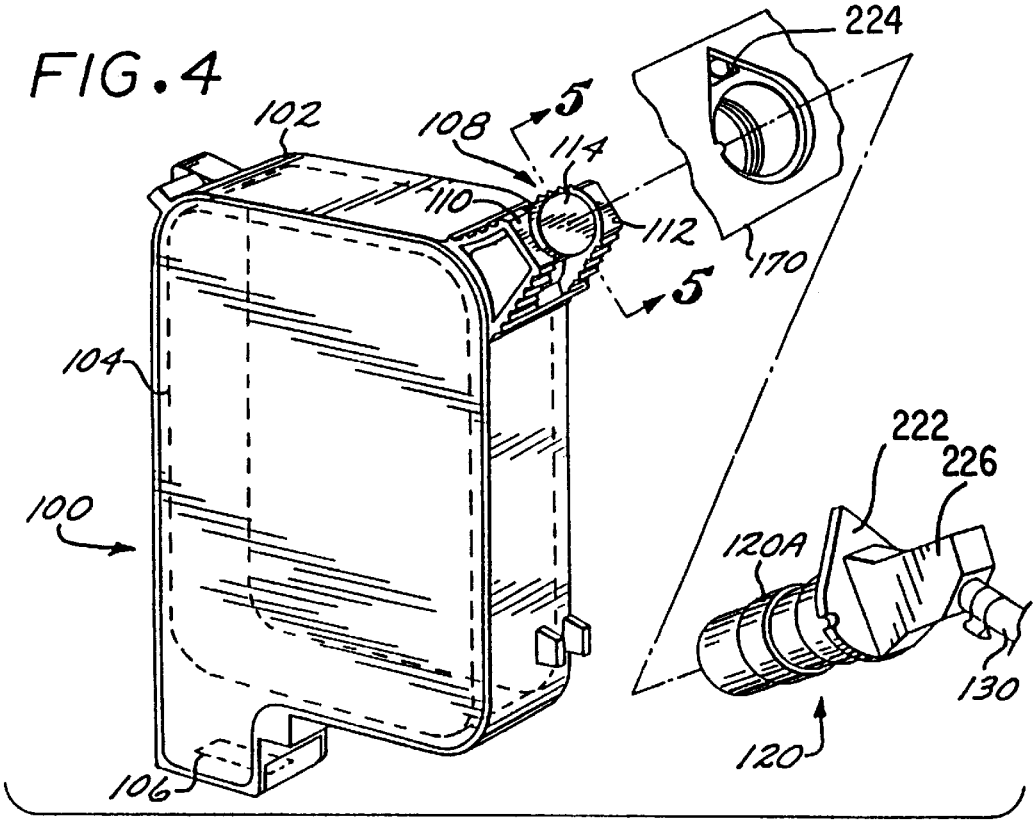
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 16) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartrigde compartments facing the print medium.

As mentioned above, full color printing and plotting required that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,860, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
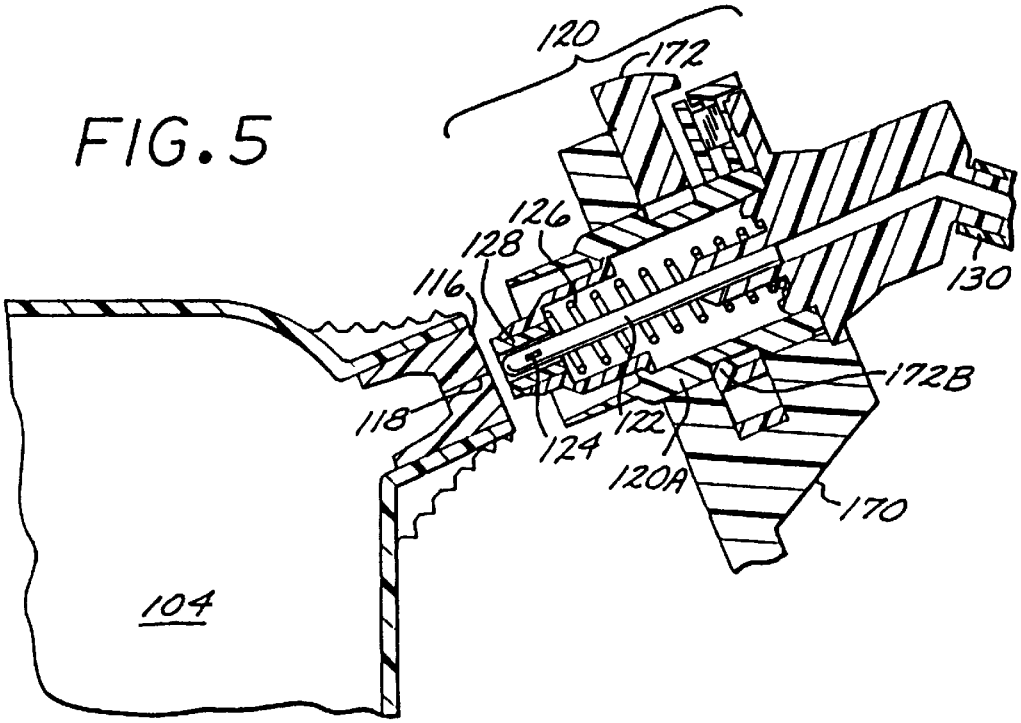
FIG. 5 is a cross-sectional view taken along line 5—5 of FIG. 4, showing the valve structure in a disengaged potion relative to a refill port on the print cartridge.
Figure 9:
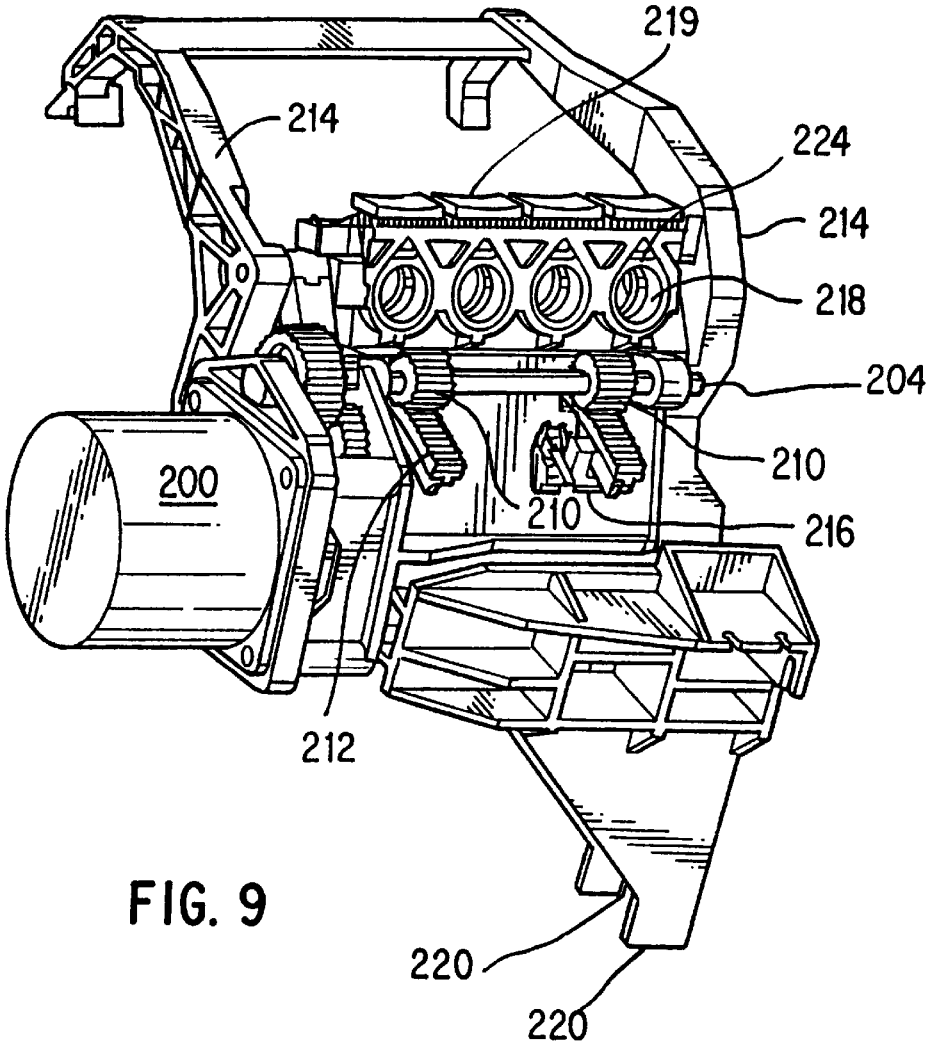
FIG. 9 is an enlarged view showing the mechanism for moving the valve structure, without any valves mounted thereon.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slid into the port opening 118, as shown in FIG. 6. In this position, ink can flow through the needle openings 124 between the reservoir 104 and the tube 130. Thus, with the cartridge 100 connected to an off-carriage ink reservoir via valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
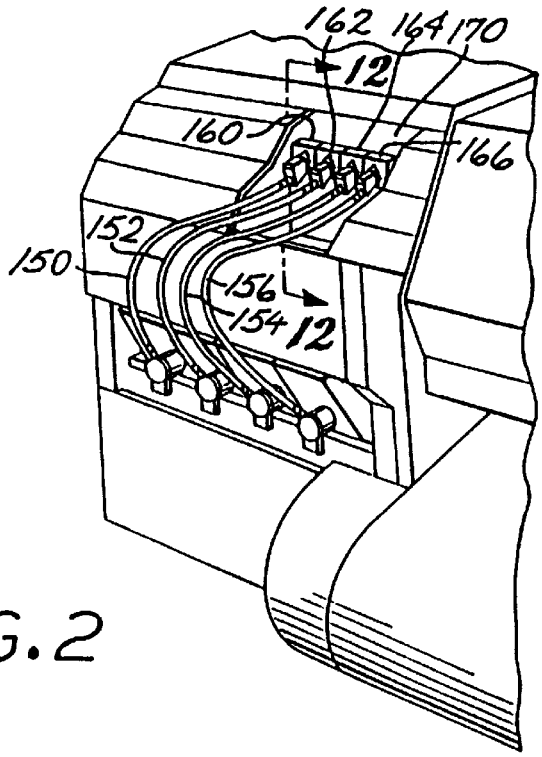
FIG. 2 is an enlarged view of a portion of the system of FIG. 1, showing the refill station.

In the exemplary system of FIG. 1, the refill platform 150 is in the left housing 56 of the printer 50 as shown in FIG. 2. The four off-carriage ink reservoirs 80–86 are supported on the platform 150. Short flexible tubes 150, 152, 154 and 156 connect between ports 80A–86A of corresponding reservoirs 80–86 and needle valve structures 160, 162, 164 and 166 supported at a refill station housing 170. These needle valve structures each correspond to the valve structure 120 of FIGS. 4–8.

The refill platform 150 is in elevator that holds the four reservoirs and can be moved up and down.

Figure 13:
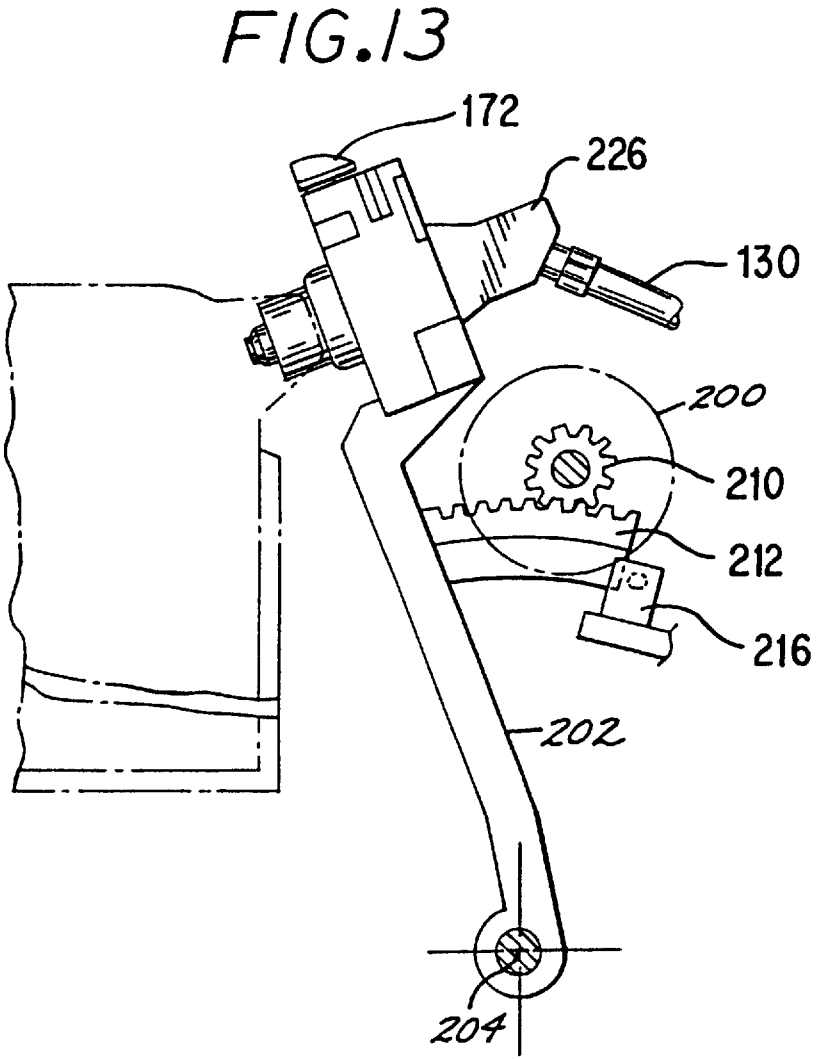
FIG. 13 is a detailed side view showing the mechanism for moving the valve structure in engaged position with a print cartridge.
Figure 12:
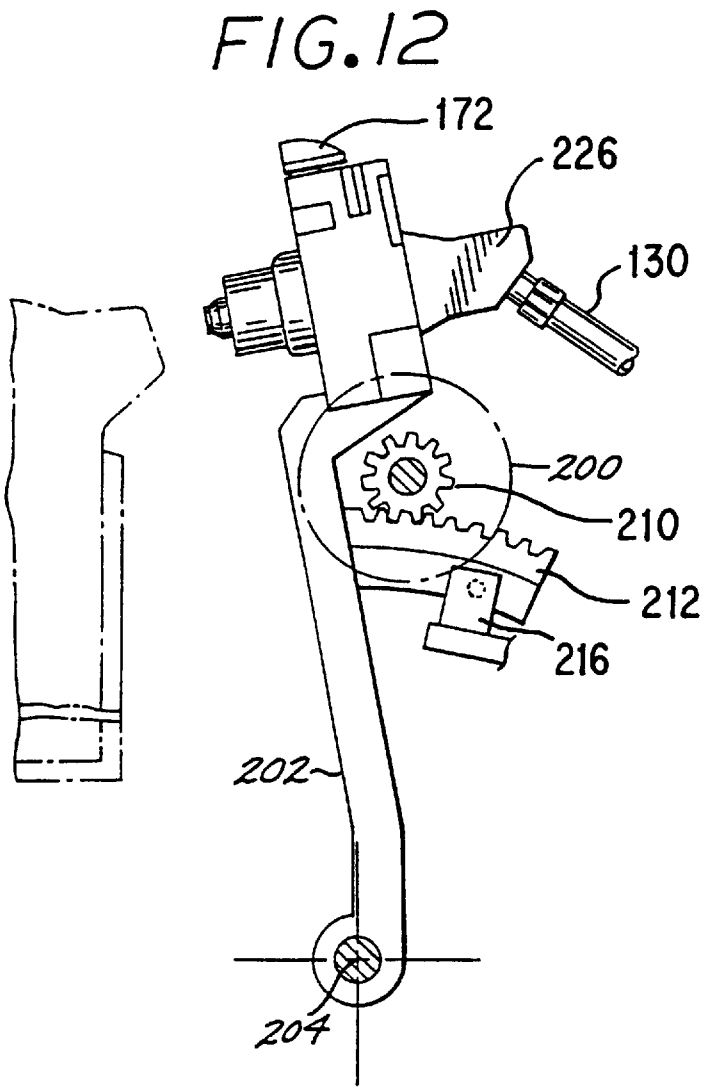
FIG. 12 is a detailed side view showing the mechanism for moving the valve structure in disengaged position with a print cartridge.

To perform a refill the carriage assembly 60 is moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 on which the valve structures and refill station housing 170 are mounted, as shown in FIGS. 3 and 12–13. A system suitable for moving the valves into and out of engagement with the refill ports is more fully described in co-pending application Ser. No. 08/805,861, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridge, the back pressure decreases to a point where the print cartridge can no longer pull additional ink from the cartridge and the refill stops. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
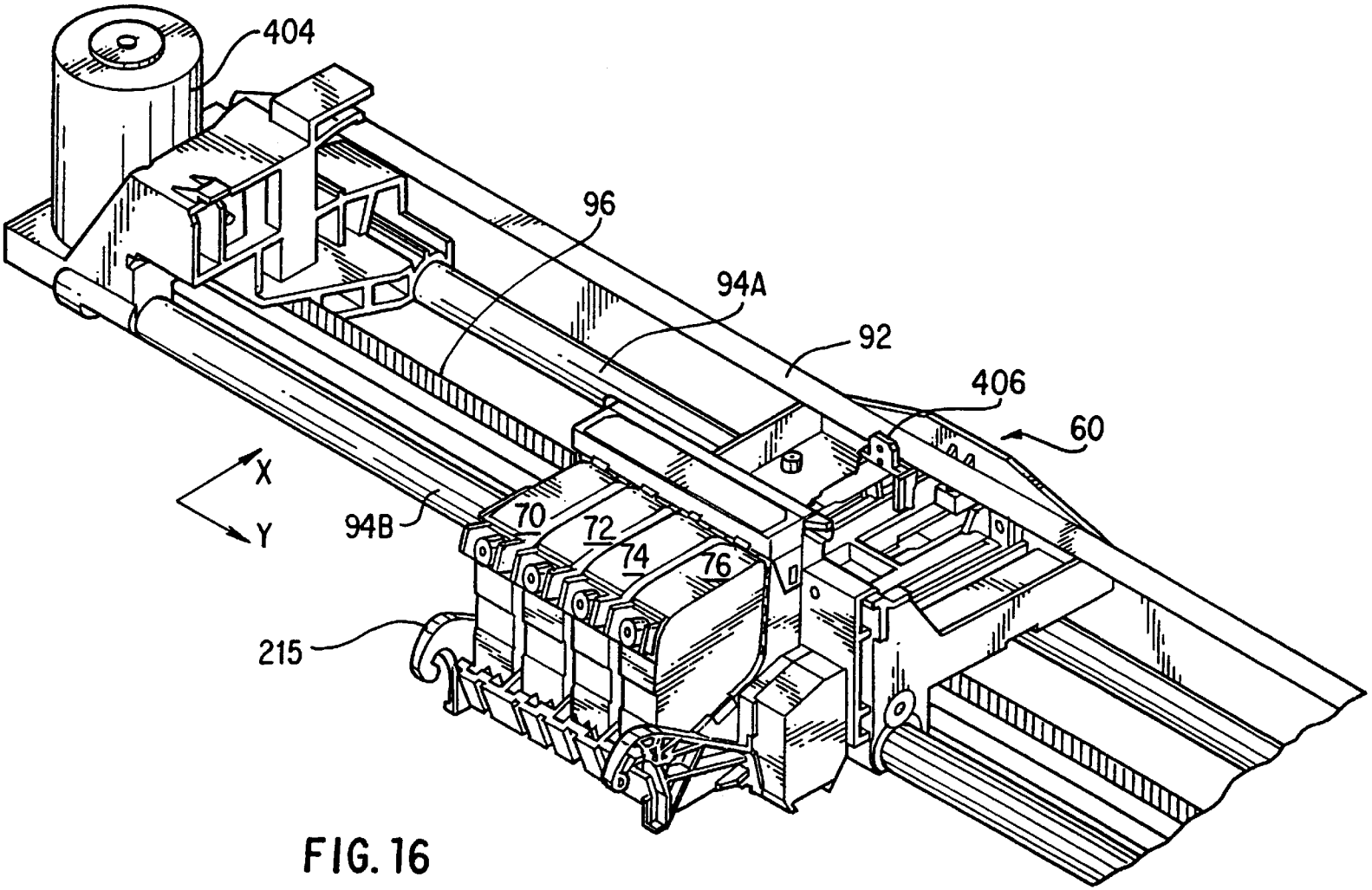
FIG. 16 is an isometric view of a carriage moving across a print zone.
Figure 17:
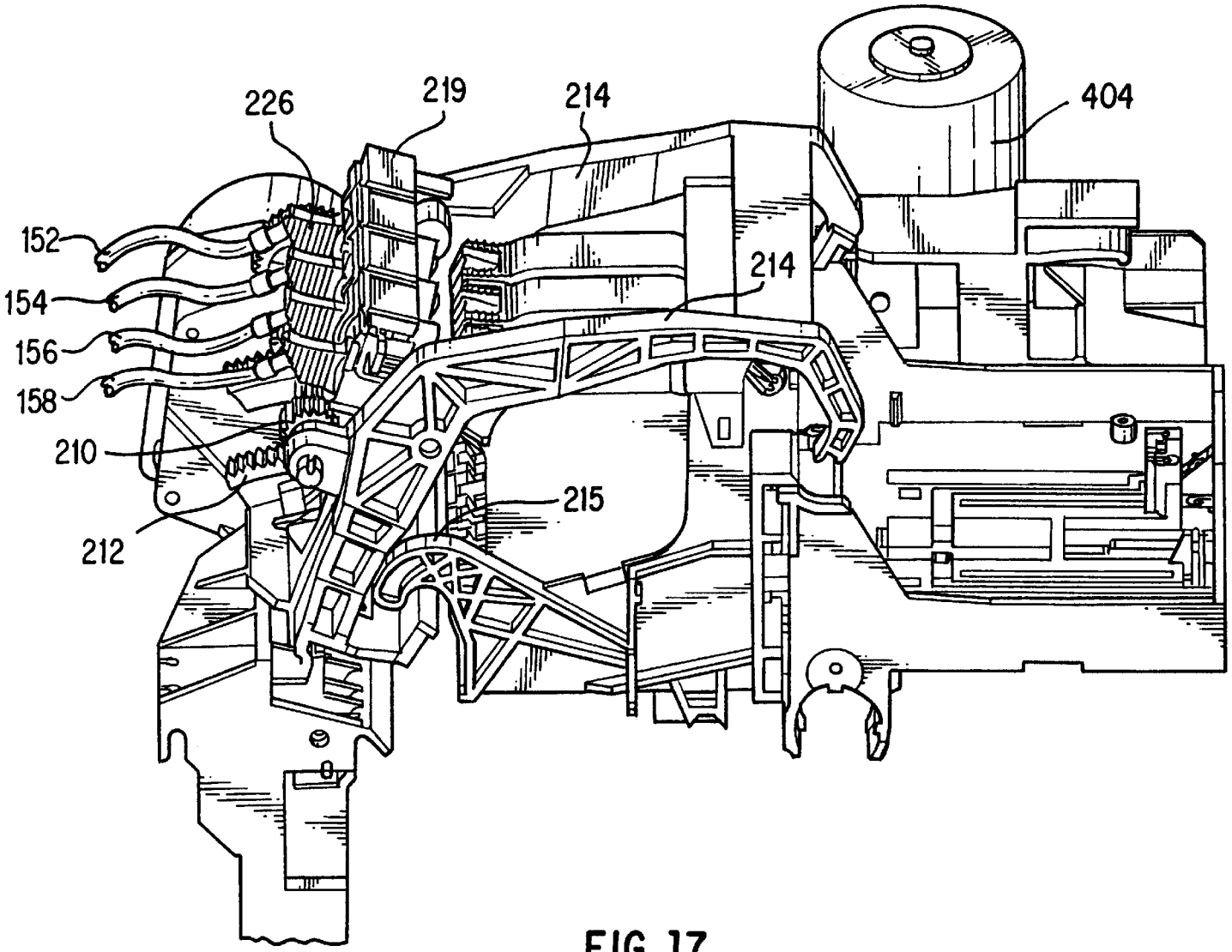
FIG. 17 shows the carriage of FIG. 16 is position at the refill station, with the valve structure in disengaged position.

As best shown in FIG. 16, the present invention does not require the specifications of the carriage to be redesigned due to the drag and interference that results from typical off-carriage ink system where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
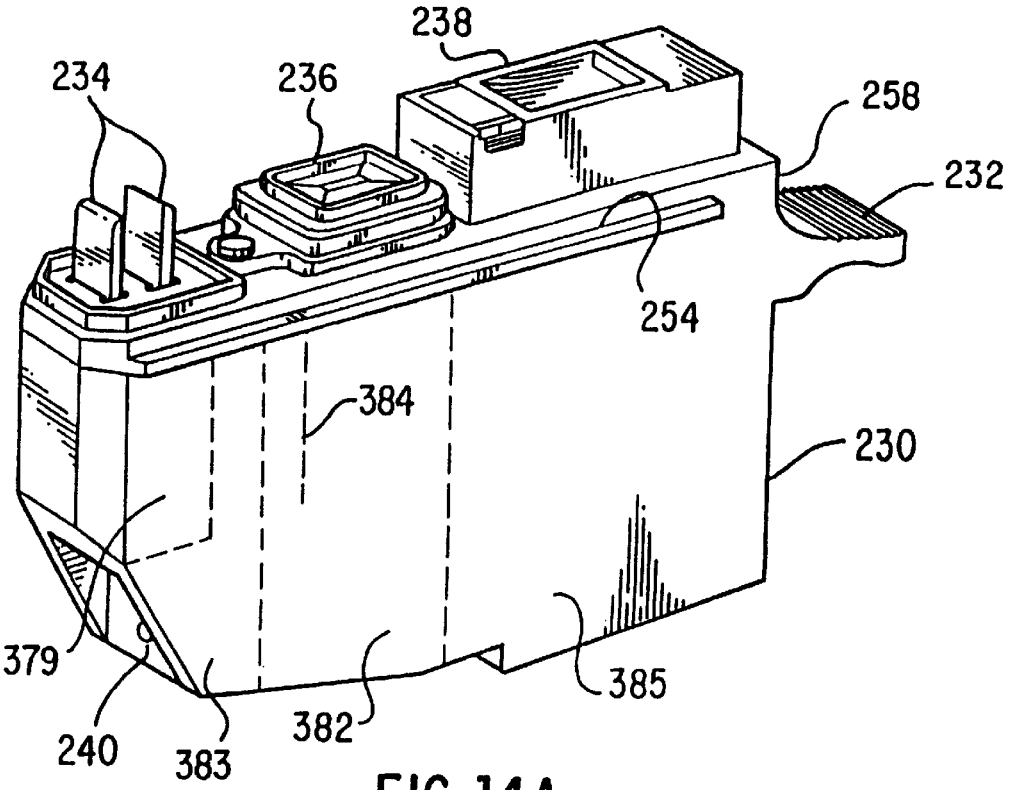
FIGS. 14A and 14B show an isometric and a side view, respectively of a service station module incorporating the present invention.
Figure 14B:
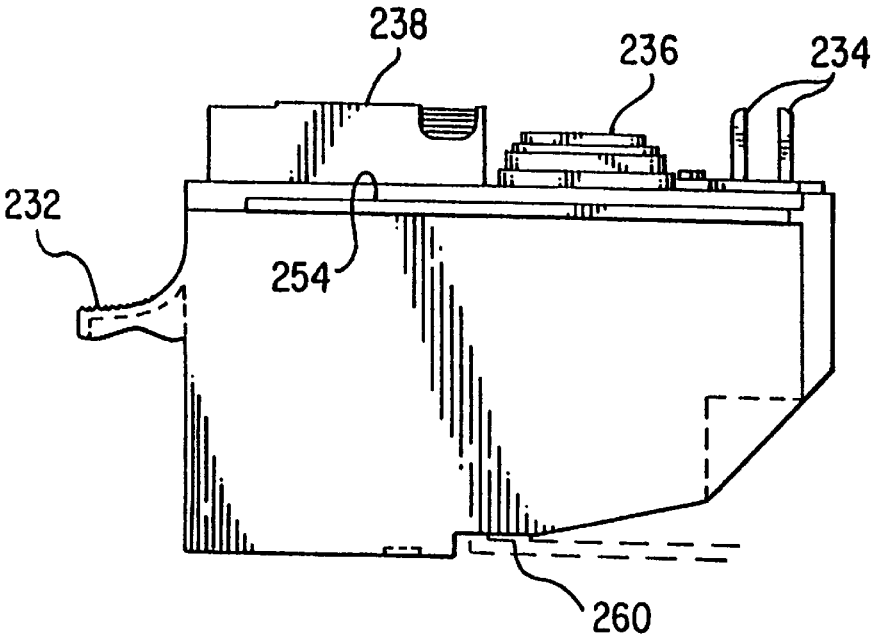
Figure 15:
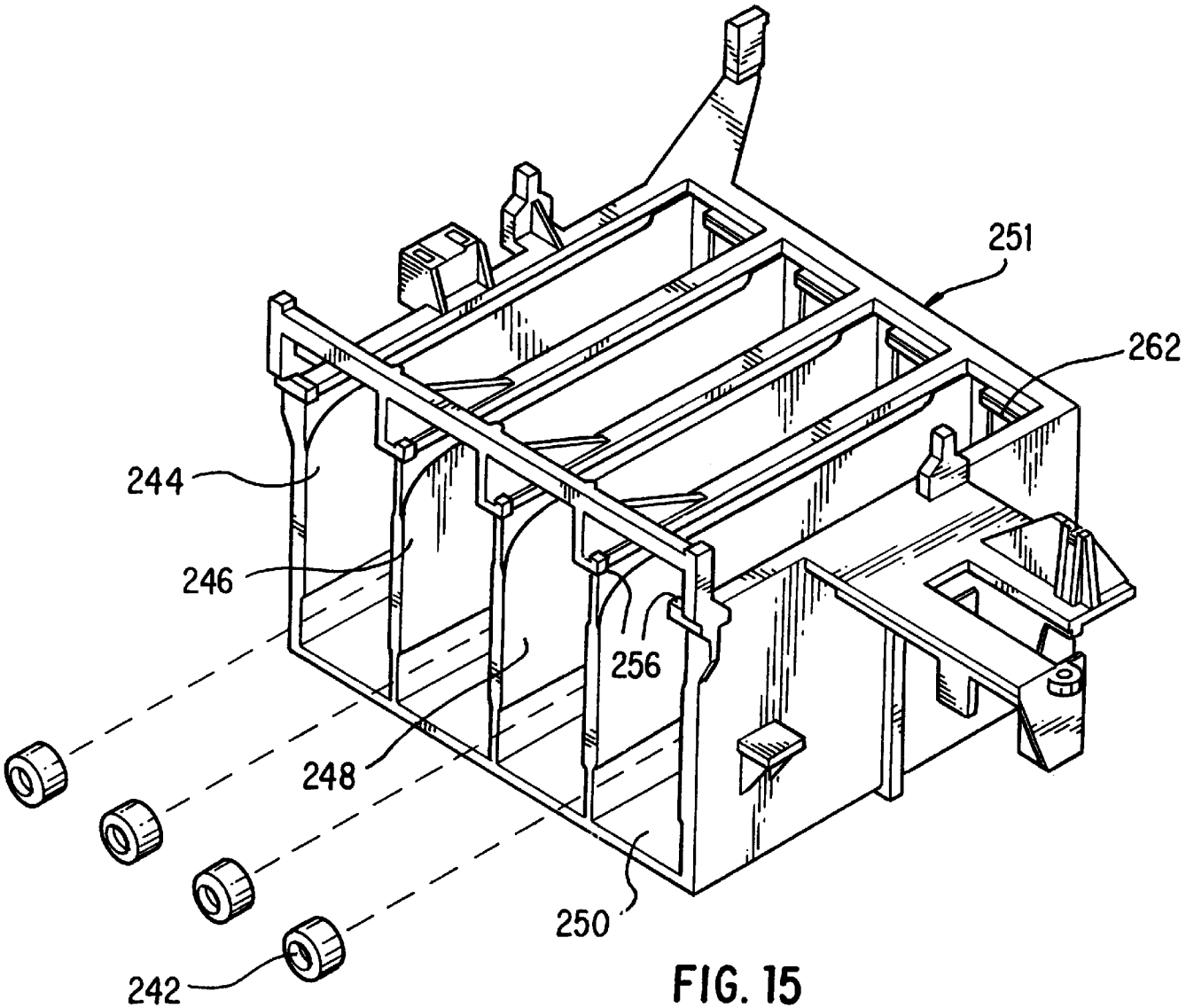
FIG. 15 is an isometric view of a carriage for removably mounting the service station module of FIGS. 14A–14B.

A unique narrow replaceable service station module 23C for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
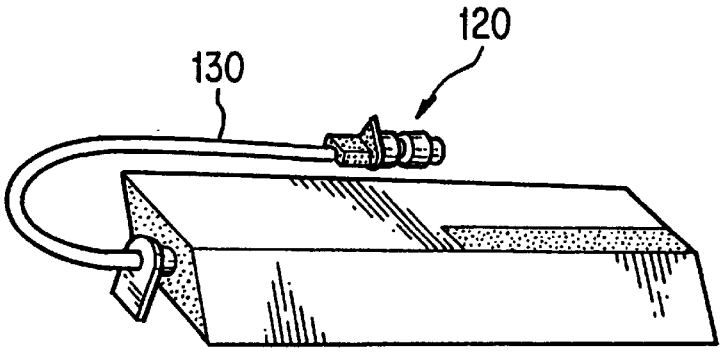
FIG. 10 shows an off-carriage ink supply module incorporating the present invention.
Figure 11:
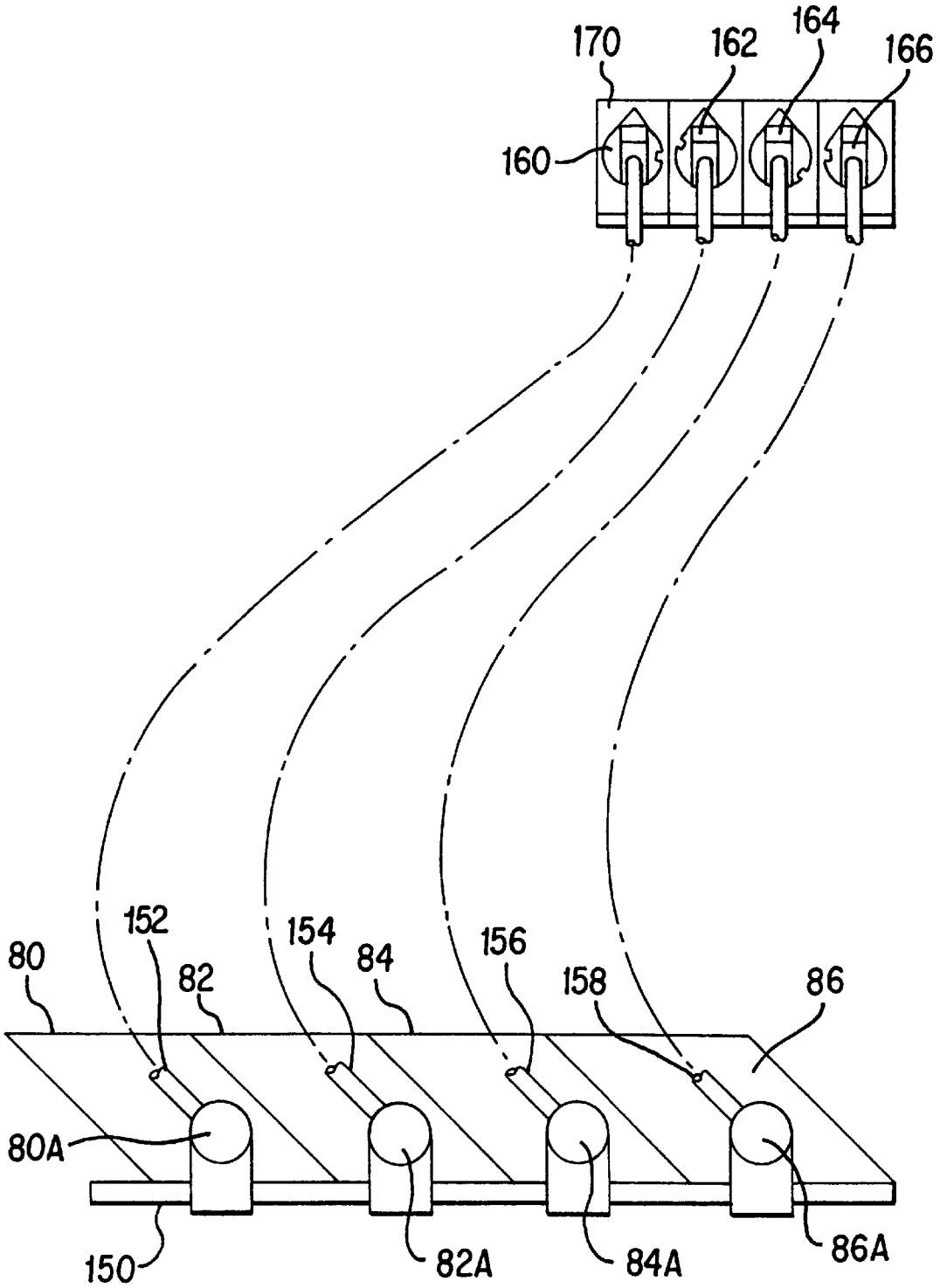
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracked.

Figure 18A:
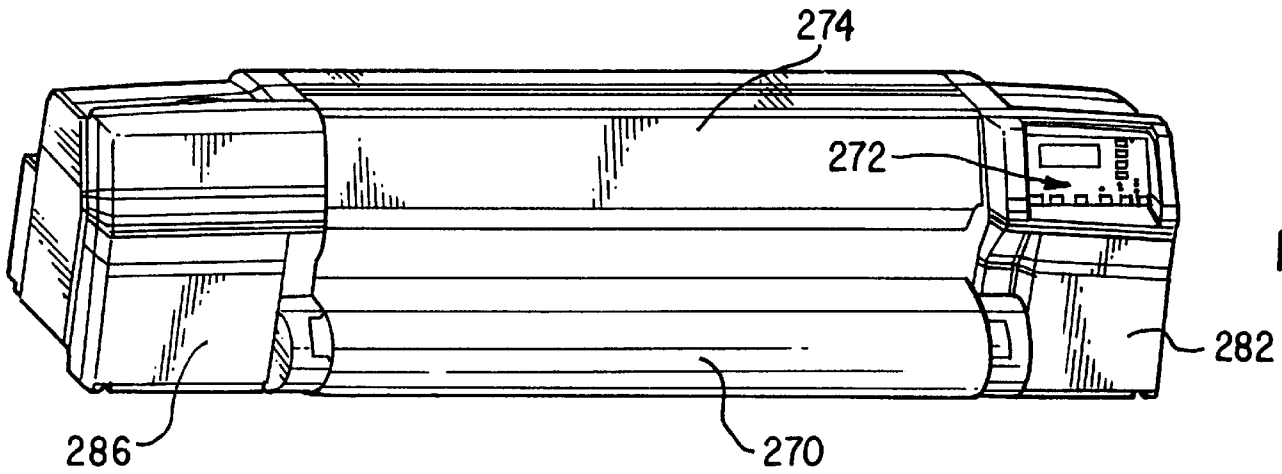
FIGS. 18A and 18B show the printer with the refill station and service station doors in closed and open positions, respectively.
Figure 18B:
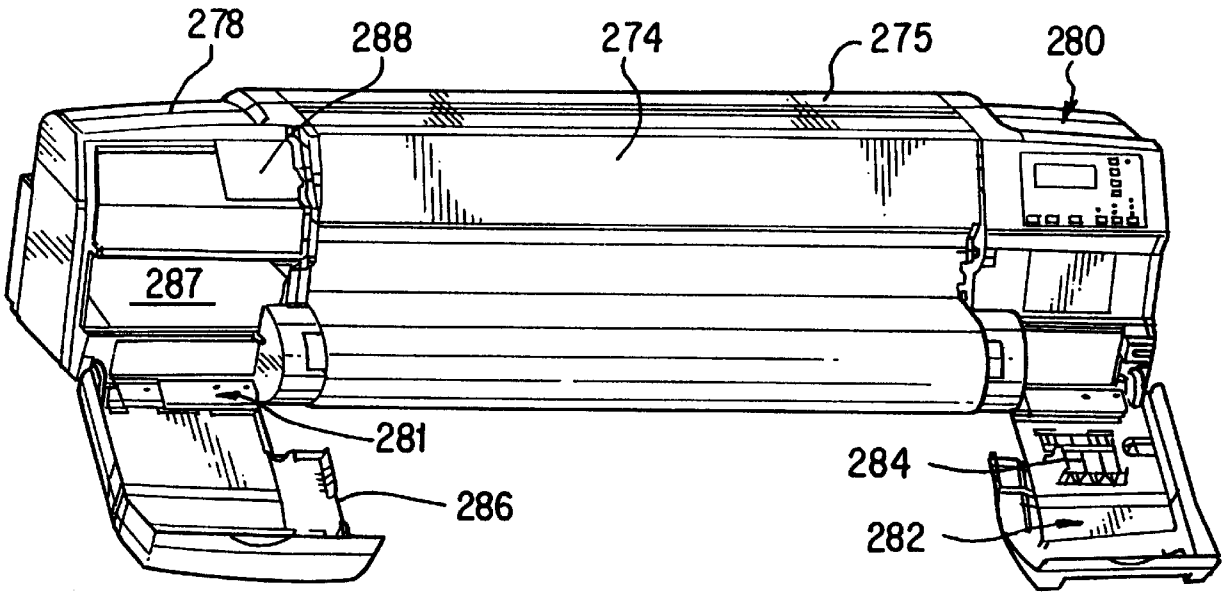
Figure 19:
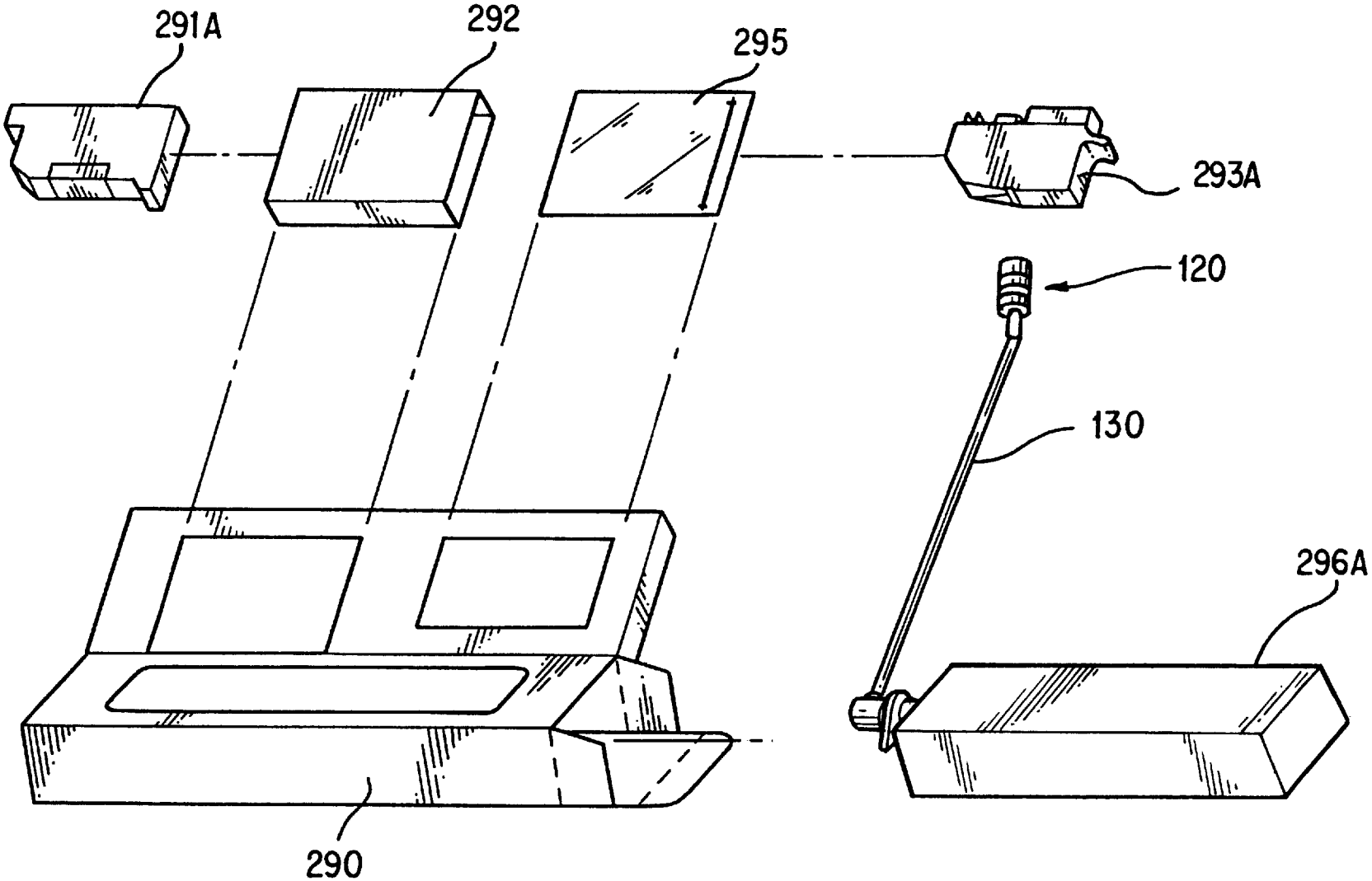
FIG. 19 is an exploded schematic view showing the integrated ink delivery system component of the invention (print cartridge, ink supply module and service station module) incorporated into a single package.
Figure 20:
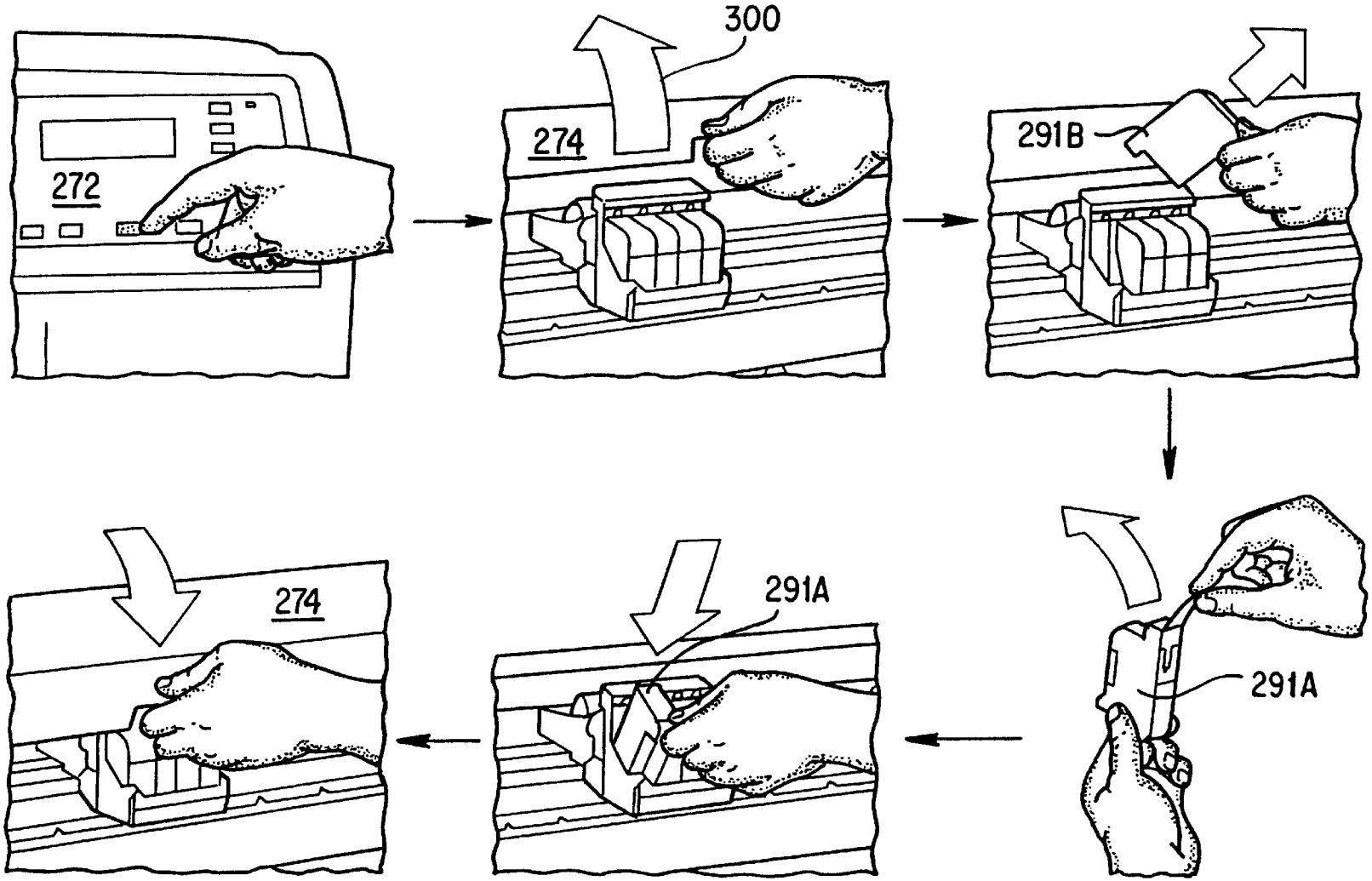
FIG. 20 shows six exemplary steps for replacing the print cartridge of the present invention.
Figure 21:
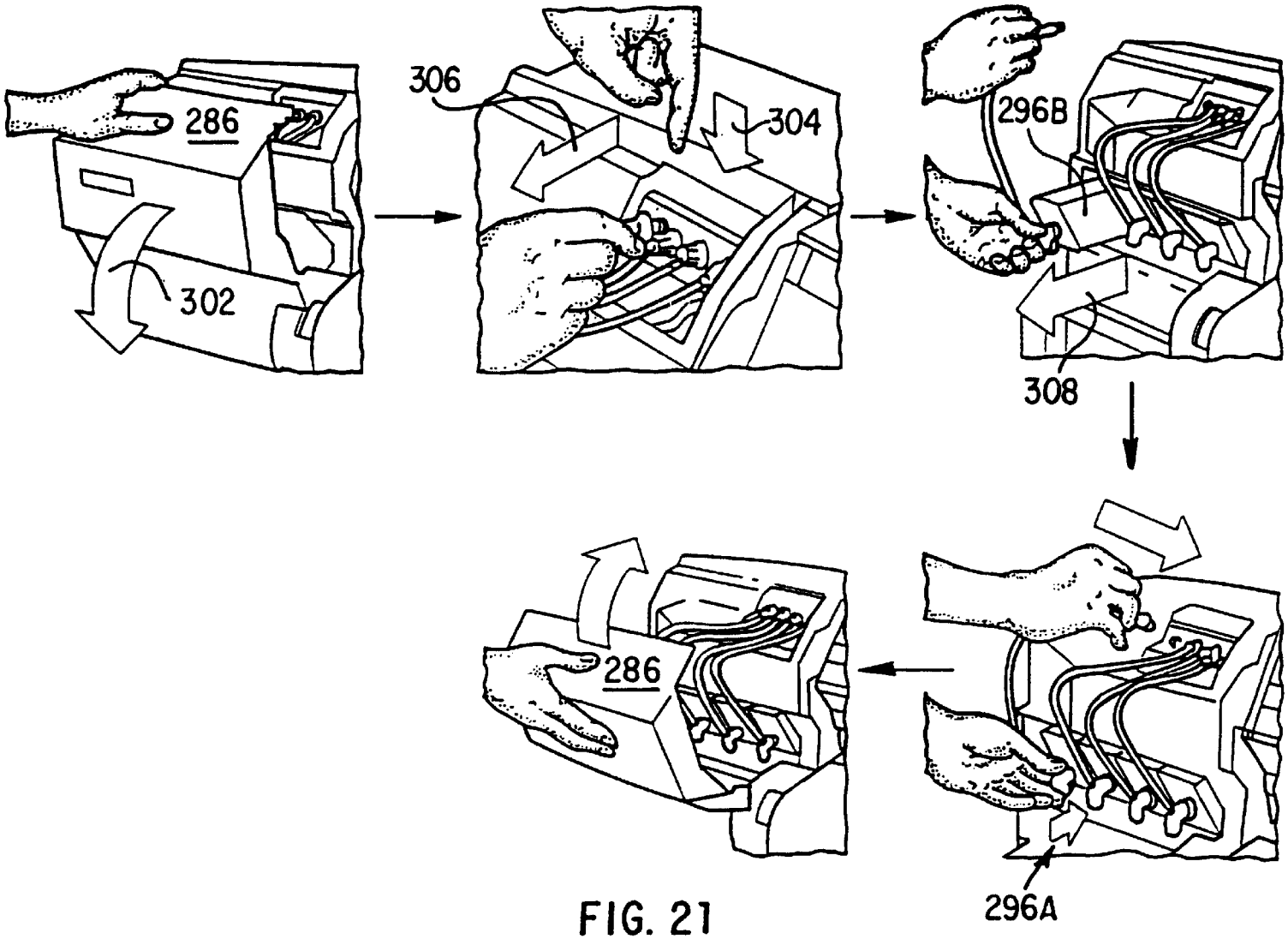
FIG. 21 shows five exemplary steps for replacing the ink supply module of the present invention.
Figure 22:
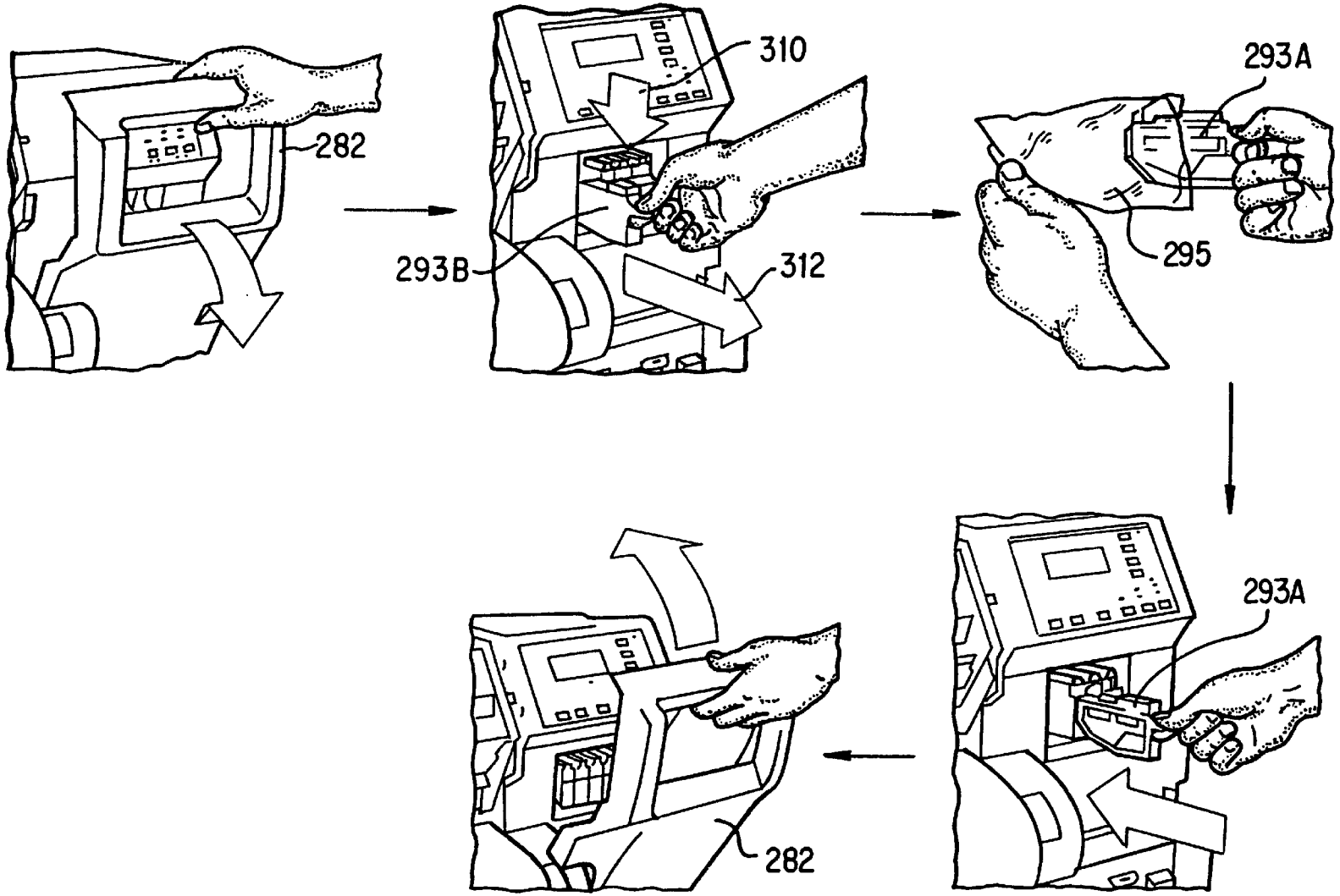
FIG. 22 shows five exemplary steps for replacing the service station module of the present invention.

FIGS. 18A and 18B illustrate the accessibility required for replacement of the three basic components parts of the IDS. The front of the printer unit typically includes a roll feed unit 270, a control panel 272 and a print zone access door 274 adjacent an elongated from member 275. The service station is located at the right end of the carriage scan axis, and a refill station 278 at the opposite end. Simple friction latches such as indicated at 280 are provided to assure proper closure of doors which a mounted on pivot hinges such as 281. A pusher plate 284 contacts and helps to position any incompletely mounted service station modules upon closure of a service station door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 20, an old print cartridge 293B is easily removed and replaced with a new one. As shown in the self-explanatory sequence of drawings of FIG. 21, a depleted ink supply module 296B is removed without difficulty by first opening the ink door as shown by arrow 302, then pushing down on the lock button as shown by arrow 304 and at the same time pulling out the valve as shown by arrow 306. The depleted ink module 296B can then be replaced with a new ink supply module 296A. Finally as shown in the self-explanatory sequence of drawings of FIG. 22, after the access door is opened a user can push down on the handle in the direction shown by arrow 310 thereby dislodging an old service station module 293B, and then pull it out all the way as indicated by arrow 312, followed by installation of a new service station module 293A.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particularly color of ink by a user, without the need of special tools and without the need of calling a specialized service person.

Figure 23:
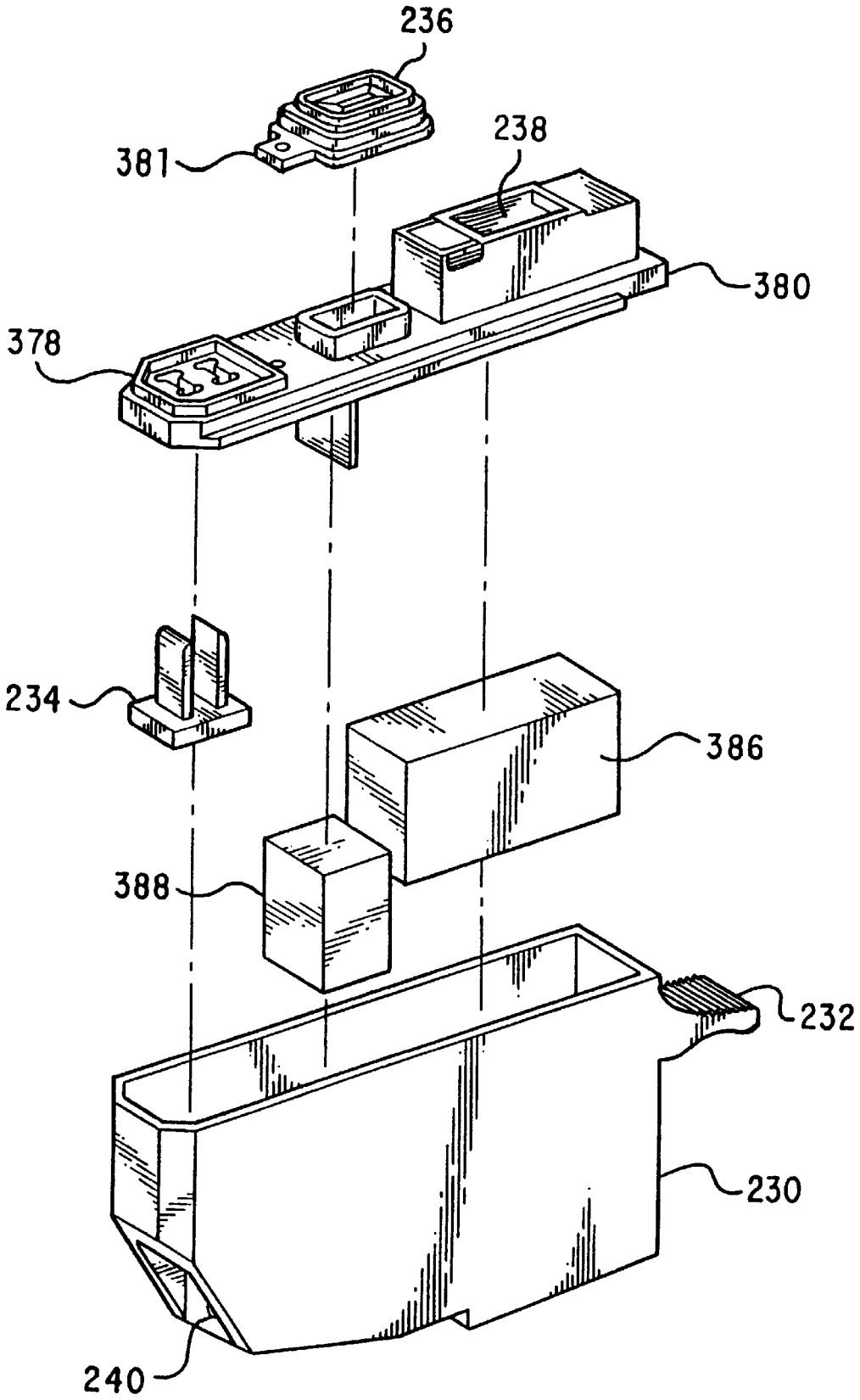
FIG. 23 is an exploded isometric view of the service station module of FIGS. 14A–14B.

Additional details of the service station module 230 are shown in FIG. 23 in conjunction with FIGS. 14A–14B. A unitary body portion defines various internal chambers and passages as well as providing a support for a top plate 380 which extends all the way across a top opening in the body portion. The spittoon 238 is in a raised position at one end of the top plate. The cap 236 is positioned and secured on the top plate with the help of a mounting tab 381, and both wipers 234 are incorporated in a single unitary part also mounted on the top plate. A drain 278 next to the wipers feeds ink from the wipers into a waste chamber 279 located in the body portion.

The primer port 240 connects through passages in the body portion to the cap. A main ink collection chamber 382 is directly under the cap and is separated from a secondary chamber 383 by a baffle 384 extending down from the top plate. In order to help prevent undue ink buildup, a larger absorbent foam block 386 is employed in the bottom of a spittoon collection chamber 385 and a similar smaller absorbent foam block 388 is placed in the bottom of the chamber 382.

Figure 24:
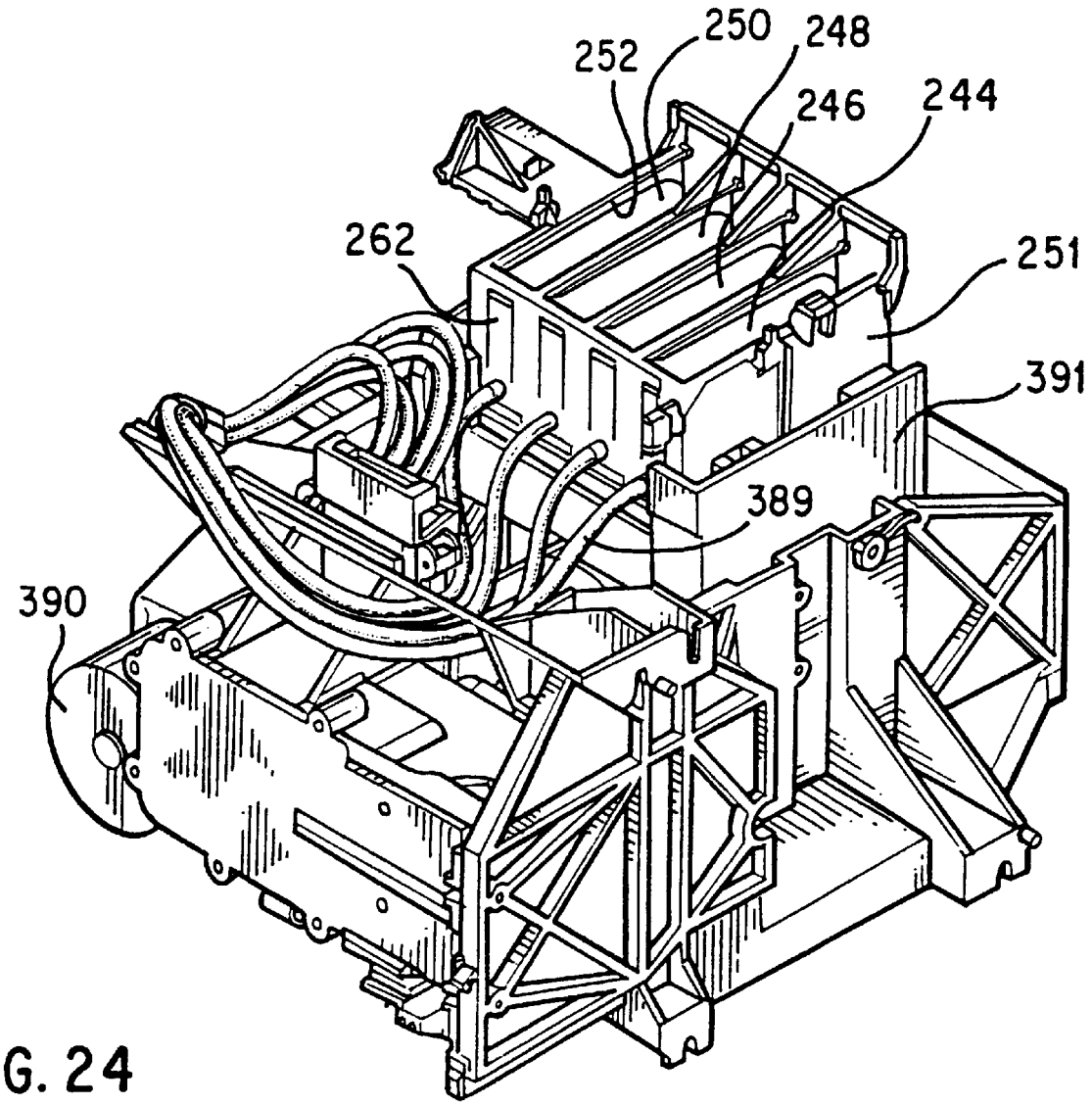
FIG. 24 is an isometric view looking down at the back of a service station unit with a service station carriage installed thereon for utilizing the service station module of FIG. 23.
Figure 25:
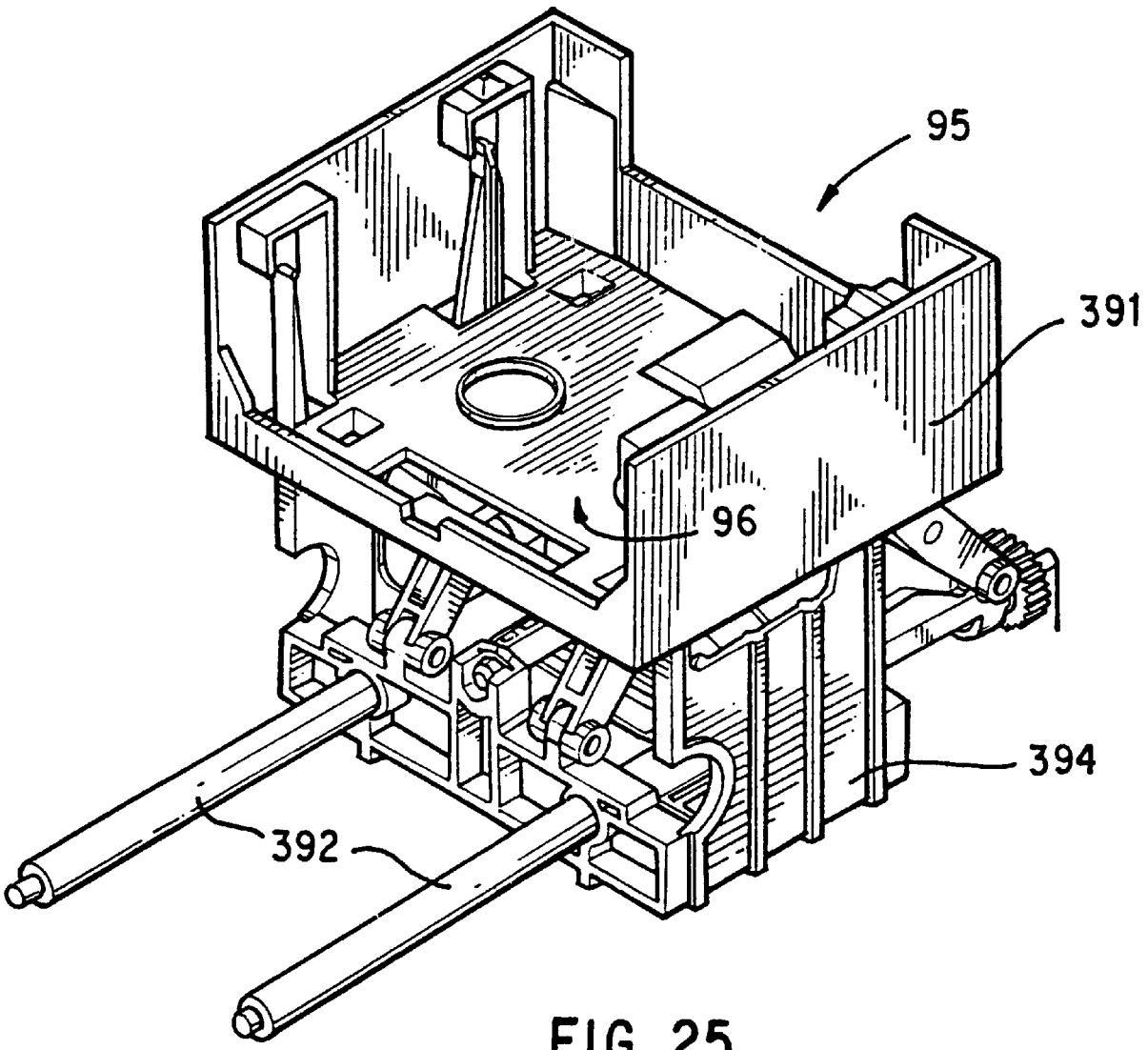
FIG. 25 is an isometric view looking down at a front portion of the service station unit of FIG. 24, without any carriage installed.

Additional details of the service station mechanism on the printer are shown in FIGS. 24–25. The service station carriage 251 has primer tubes 389 attached from the rear to the respective primer ports 240. A motor 390 is provided to move a platform 391 along slide rods 392 as part of various servicing operations as well as to position the carriage for installation or removal of individual modules by a user. The entire service station mechanism is supported by a chassis 394, and the platform includes a rear access 95 for the primer tubes 389 as well as a front access 396 to facilitate the aforementioned installation or removal of individual modules from the service station carriage.

The primer system employed in the present invention will now be described in greater detail with referent to FIGS. 26, 27, 28A and B and 29A and B. Priming of printheads 70 is required for two primary reasons. Firstly for lubrication of the nozzle plate of the printhead and secondly to recover nozzles which have been blocked by dried ink. In both cases a vacuum is applied to the nozzle plate through the nozzle plate cap 236 in order to such ink from the printhead. Since the cap 236 is mounted on a removable service module 230, some provision must be made to connect the cap to a vacuum generator, also known as a primer, within the printer.

Figure 26:
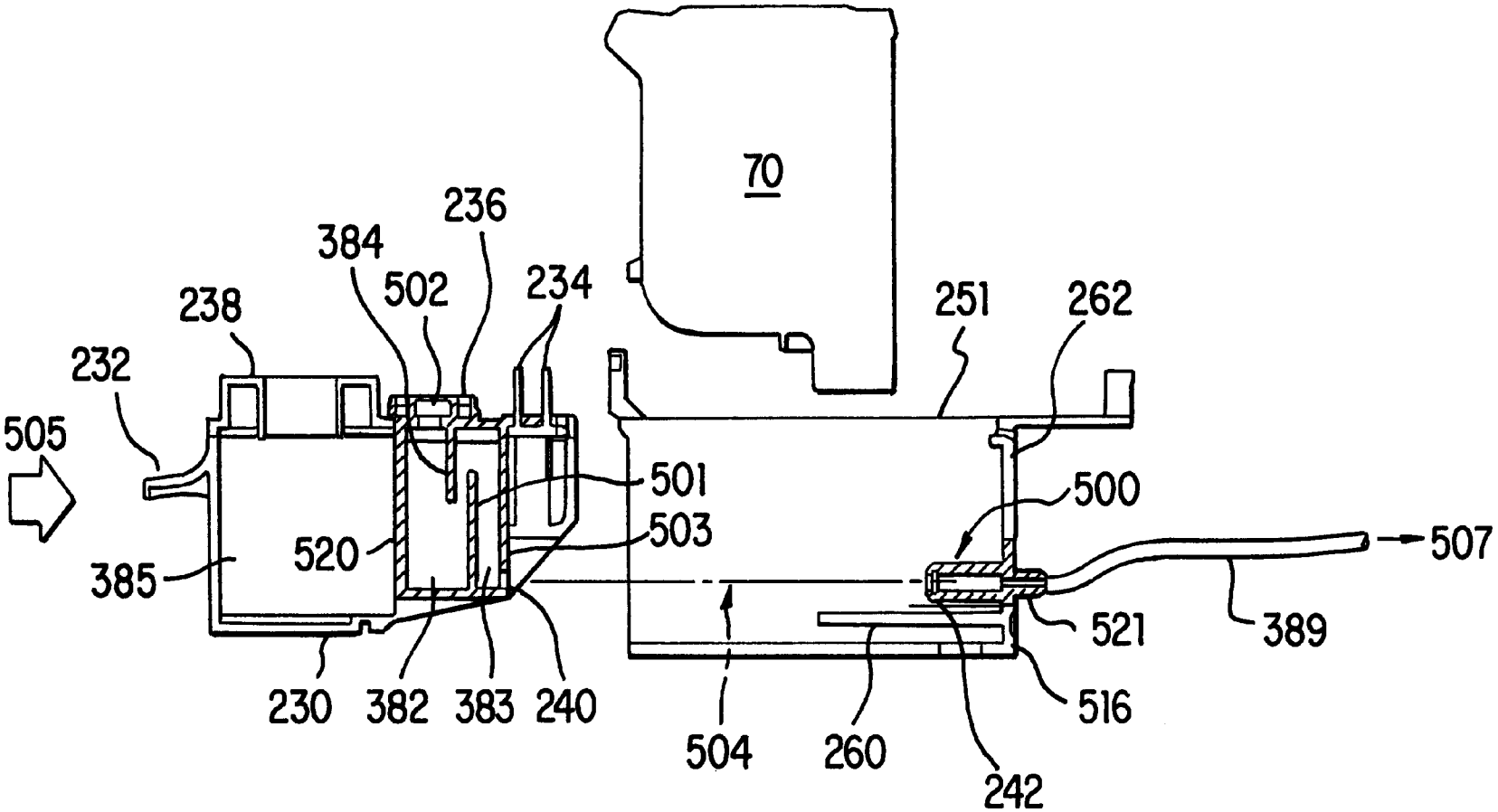
FIG. 26 shows a longitudinal cross-sectional view of the service module of FIG. 23 and the service station carriage of FIG. 25 prior to the insertion of the service module into the service station carriage.

FIG. 26 is a longitudinal cross-sectional view of the service module 230 showing an ink separation chamber 520 within the service module. The ink separation chamber 520 comprises two sub-chambers or compartments, an ink compartment 382 and an air compartment 383. These compartments are separated by two baffle walls, one baffle wall 384 extends down from the top plate of the service module 230 while the other baffle wall 501 extends upwardly from the base of the service module. The ink compartment 382 is directly connected to a central hole 502 in the cap 236 which form the entrance for ink from the printhead 70 into the service module 230. The primer port 240 for the service module comprises a hole in one of the walls 503 of the air compartment 383 of the ink separation chamber 520, positioned at the lower end of the wall close to the base of the service module.

FIG. 26 also shows a longitudinal cross-section through the middle of a slot 244 (shown in FIG. 24) of the service station carriage 251. Extending from the rear wall 516 of the slot 244 into the service station carriage is a primer connector 500 having at its end a circular seal 242. Extending from the opposite side of wall 516 and aligned with the primer connector 500 is a nipple 521 over which a primer tube 389 is attached. The other end of the primer tube 389 is connected to the primer of the printer.

The arrow 505 shows the installation direction of the service module 230 into the service station carriage 251, while the alignment line 504 shows the alignment of the primer port 240 of the service module with the primer connector 500 of the service station carriage. As the service module is inserted into, and located within the service station carriage, as previously described above, the primer port 240 engages the circular seal 242 of the primer connector 500 and is thus automatically connected to the primer of the printer. Hence there are no further actions that a user of the printer need take to achieve a priming connection other than simply to install the service module.

Figure 27:
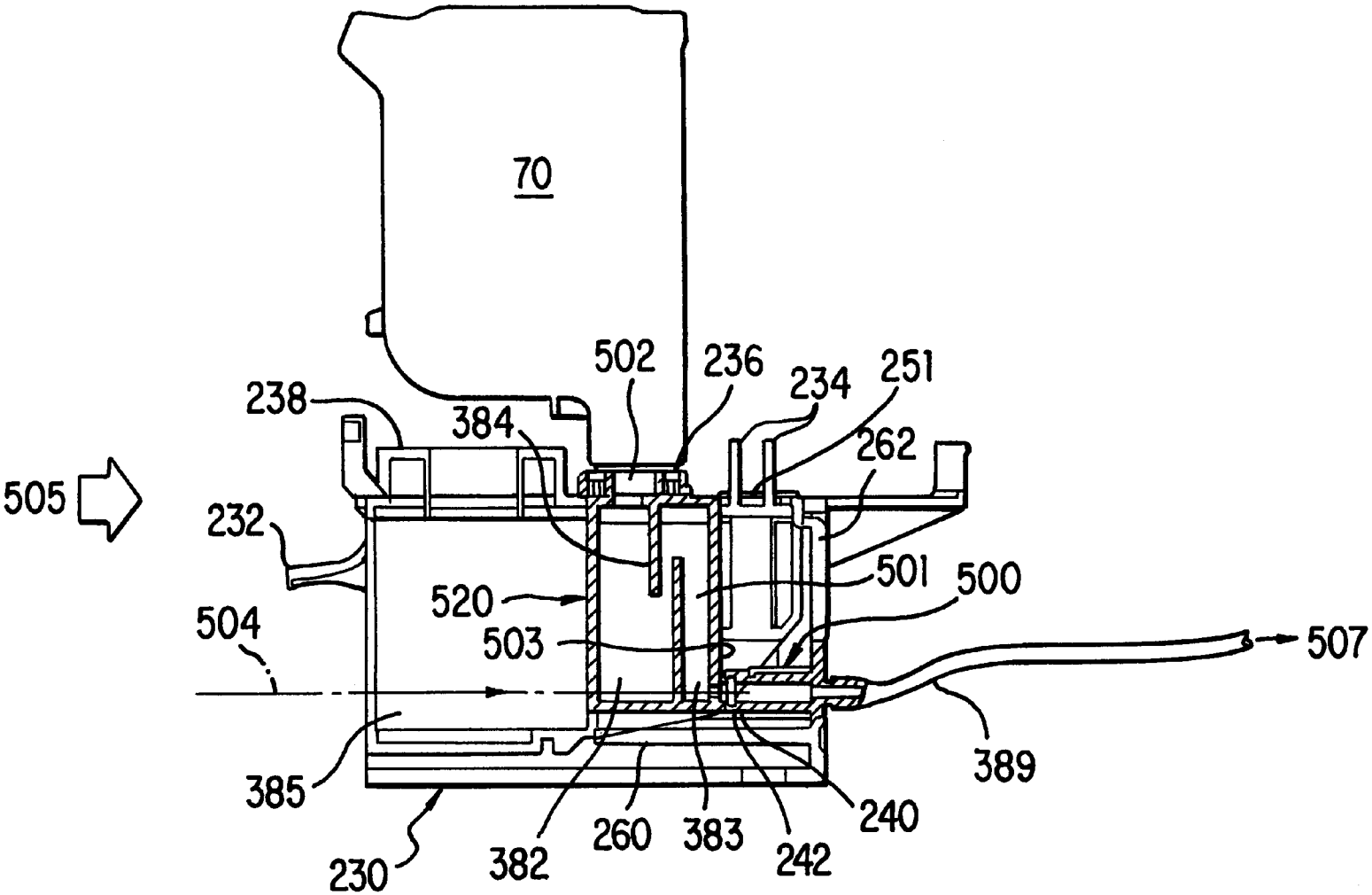
FIG. 27 shows the longitudinal cross-sectional view of FIG. 26 after the insertion of the service module into the service station carriage.

FIG. 27 shows the service module 230 fully installed in the service station carriage and also shows a printhead 70 engaged with the cap 236 of the service module and thus in a capping and/or priming position. As can be seen the nozzle plate of the printhead is in very close proximity to the ink compartment 382 of the ink separation chamber. This is advantageous since when printheads are not being used for printing they may be capped for considerable periods of time and there is a risk that ink in the nozzles may dry and block the nozzles. The close proximity to the ink compartment ensures that the storage atmosphere around the nozzle plate has a substantial quantity of ink vapour and thus impedes drying. A further advantage of this arrangement is that it avoids the use of tubes (for example between the cap and an ink compartment) which often become blocked if ink is passed through them.

When a prime of the printhead 70 is performed the primer of the printer applied a vacuum to the primer tube 389 which is transferred through the primer connector 500, primer port 240, and ink separation chamber to the cap 236 and ultimately the nozzle plate. Ink that is sucked out of the printhead falls into the ink compartment 382 of the ink separation chamber 520. The baffle walls 384 and 501 of the chamber ensure that the air drawn through the chamber follows a convoluted path and hence that ink is not drawn with the air into the air compartment 383. The location of the primer port 240 at the base of the wall 503 of the air compartment ensures that neither it, nor the primer connector 500 are contaminated by ink. This is important since if ink were to contaminate the joint between the service module and the service station carriage either the seal between the two would not be effective or the service module may adhere to the primer connector.

The primer connector 500 will now be described in greater detail with reference to FIGS. 28A and B and 29A and B. FIG. 28A is a perspective view of the service station carriage showing a partial cross-section through one of the slots 250 of the carriage to show the primer connector. As is best seen in the enlarged view of FIG. 28B, the primer connector 500 comprises a cylinder 513 extending from the rear wall 516 of the slot 250. The cylinder has a number of fins 511 separated by channels 514 along its length. Towards the end of the cylinder 513 is a reduced diameter section 510 having a vent hole 512. This section 510 receives the circular seal 242.

Figure 29B:
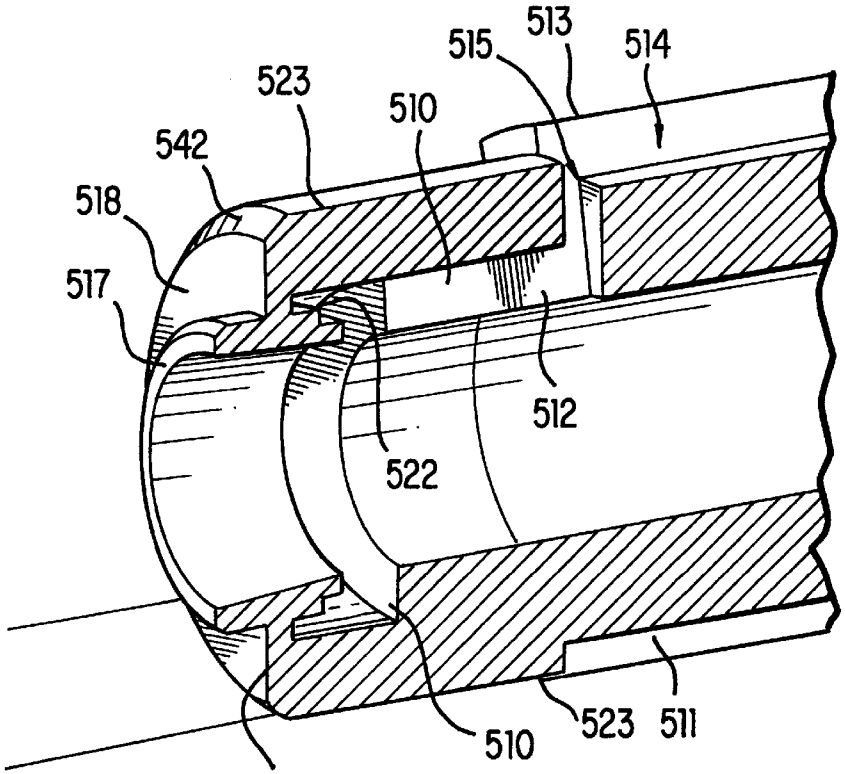
FIG. 29B is an enlarged cross-sectional detail view of the primer connector of FIG. 29A showing the sealing cap.
Figure 29A:
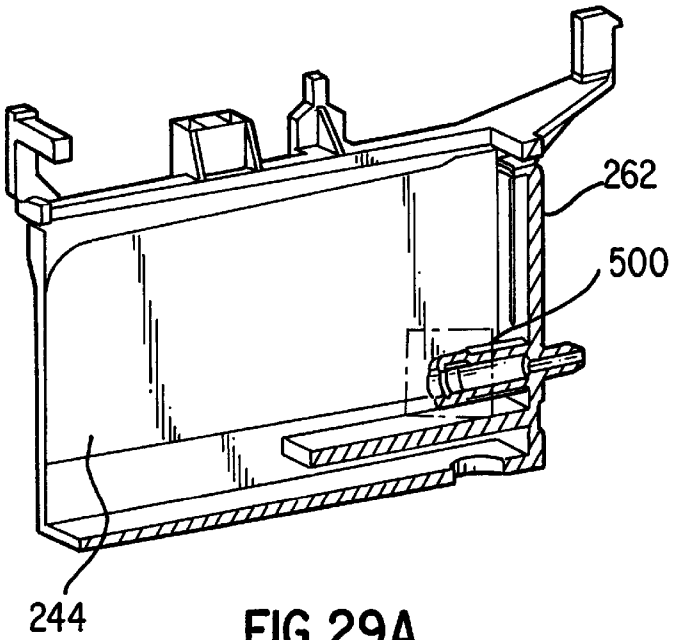
FIG. 29A shows a longitudinal cross-sectional view through the primer connector of FIG. 28.

FIG. 29A, and in greater detail 29B, show a longitudinal cross-sectional view through the primer connector which is shown with the circular seal, in the form of a cap, in place over the reduced diameter portion 510. The seal 242 is formed of a rubber material and has a main body 523 which forms a cylinder sized so as to snugly fit over and grip the reduced diameter section 510 of the primer connector 500. At one end the seal has ahead portion 518 which comprises a lip 517 mounted on a thin wall 522 to the rest of the head portion 518. This design allows the lip 517 to make good sealing contact with the primer port 240 of the service module 230. Furthermore it also allows the lip to move somewhat in the installation direction of the service module so that in does not cause the required installation force of the service module to rise excessively. A further advantage of a efficient seal design is that a corresponding rubber seal on the service module is found not to be necessary. This reduces the cost of the service module which is a disposable consumable.

Figure 28B:
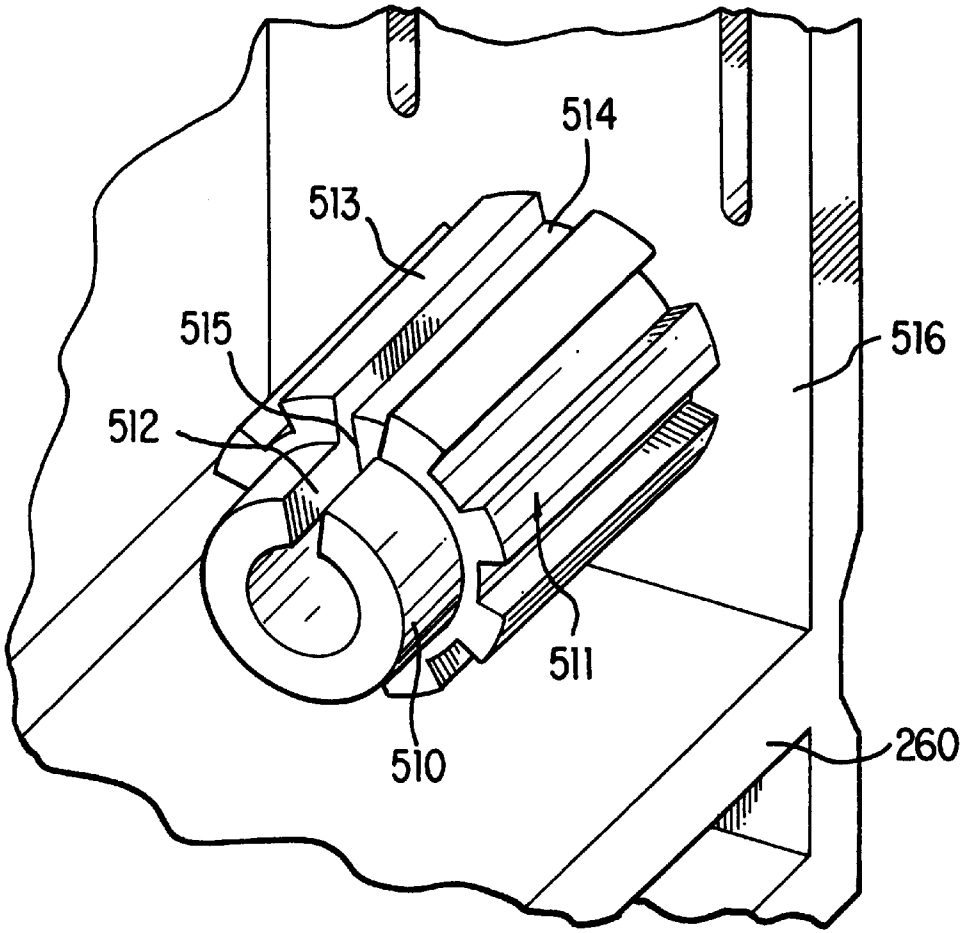
FIG. 28B is an enlarged perspective detail view of the primer connector of the service station carriage of FIG. 25.
Figure 28A:
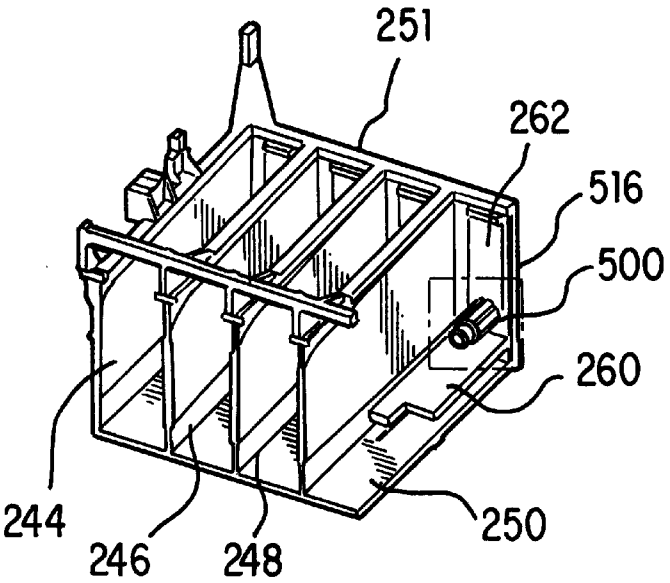
FIG. 28A is a perspective view of the service station carriage of FIG. 26 with a partial cross-sectional view through one of the slots of the carriage to show the primer connector.

As can be seen from FIG. 29B and FIG. 28B once the seal 242 is in place there is a small hole or slot 512 and 515 through which air may enter the priming system. This acts as a vent for the priming system, allowing air to slowly enter and reduce the vacuum within the service module once a priming operation has been finished. Once the vacuum has been released, it is important that the vent does not allow a high flow of air into or out of the service module so that the ink within the ink compartment of the ink separation chamber does not dry and the air within the compartment retains a high ink vapour content. This helps to prevent drying of the ink on the nozzle plate of the printhead.

The release of the vacuum can also be achieved by the primer, rather than a vent, but if a vent is employed the design of the primer and its control can be simplified. It should also be noted that by locating the vent on the air side of the ink separation chamber it is ensured that it will not become blocked by ink.

It is to be understood that certain features of the service station module and the service station carriage are optional and are not required in order to obtain the benefits of the invention. For example, the foam inserts are helpful but not required in order in the ink collection chambers inside of the service station module. Similarly, while some form of restraint is desirable to assure secure positioning of the module in the carriage, it is not necessary to have positive biasing forces in all of the X, Y and Z axis directions. In a currently preferred form, only a biasing spring in the Z axis direction is to be employed in a proposed commercial embodiment of the invention, thus relying on a somewhat snug mechanical fit in the other axis directions. Also, such spring need not be a plastic extension of the carriage as presently used in a preferred embodiment, but could be a separate spring of different material. And other holding techniques could also be employed rather than a spring in order to stabilize the service station component sufficiently to perform its various functions relating to the cleaning, maintenance, enhancement and protection of the printhead.

Thus, once the service station modules are securely positioned in the service station carriage, all of the various important servicing function (wiping, capping, priming, spitting, or selected sub-groups thereof) required for reliable operation of an inkjet printhead can be done in conjunction with a single module or cleaner which is dedicated solely to a single printhead and which can be removed and replaced at the same time that the associated printhead is removed. Thus the coordination of expected life of the service station module, ink supply module and printhead is an important feature of the invention. When a different ink supply such as UV ink for outdoor usage is required, an entire ink delivery system (including ink and ink-related components) can be easily replaced.

While a preferred embodiment of the invention has been shown and described, it will be appreciated by those skilled in the art that various modifications can be made without departing from the spirit and scope of the invention as defined by the following claims.

I claim:

1. A replaceable service module for use with an inkjet printer having at least one inkjet printhead mounted in a printer carriage and a service zone for printhead servicing functions including printhead priming, the service module comprising:

a body portion;

interfacing means on the body portion for engaging a nozzle plate of a printhead to perform priming functions;

a primer port on the body portion for connection to an external vacuum source located within the printer;

a path through the body portion between the interfacing means and the primer port; and wherein the body portion is removably insertable within a service station carriage located within the service zone of the printer and wherein the primer port is located so that a connection is made between the primer port and the external vacuum source as the body portion is inserted into the service station carriage.

2. A service module as claimed in claim 1, wherein the service station carriage comprises a primer connector for connecting to the primer port and wherein the connection direction between the primer port and the primer connector is substantially parallel to the insertion direction of the body portion into the service station carriage.

3. A service module as claimed in claim 2, wherein the priming connection between the body portion and the external vacuum source is achieved by the insertion of the body portion into the printer by a user of the printer without any further actions by said user.

4. A service nodule as claimed in claim 3, wherein the primer port comprises an orifice in a wall of the body portion, and the primer connector comprises sealing means for forming a substantially air-tight seal around said orifice.

5. A replaceable service module for use with an inkjet printer having at least one printhead mounted in a printer carriage and a service zone for printhead servicing functions including printhead priming, the service module comprising:

a body portion;

interfacing means on the body portion for engaging a nozzle plate of a printhead to perform priming functions;

a primer port on the body portion for connection to a primer source located within the printer;

a path through the body portion between the interfacing means and the primer port; and an ink separation chamber located within the path between the interfacing means and the primer port.

6. A service module as claimed in clam 5, wherein the ink separation chamber has an entrance directly from the said interfacing means and an exit directly to said primer port.

7. A service module as claimed in claim 5, wherein the ink separation chamber comprises an ink compartment and an air compartment separated by at least one baffle wall.

8. A service module as claimed in claim 7, wherein the ink compartment and the air compartment are separated by a plurality of baffle walls which overlap so as to cause changed of direction in the flow of air from the entrance to the exit of the ink separation chamber.

9. A service module as claimed in claim 7, wherein the ink compartment of the ink separation chamber is directly adjacent to the means for interfacing with a nozzle plate of a printhead.

10. A service module as claimed in claim 7, wherein the primer port of the service module is located on the air compartment side of the ink separation chamber.

11. A service module as claimed in claim 10, wherein the primer port comprises an orifice in a wall of the air compartment of the ink separation chamber.

12. A service module as claimed in claim 7, wherein the means for interfacing with a nozzle plate of a printhead comprises a nozzle plate cap which is also utilised for capping the printhead when not in use by the printer, the nozzle plate cap having a lip for forming a seal around a nozzle plate, said lip encircling a central orifice within the nozzle plate cap, wherein said central orifice forms an entrance to the ink compartment of the ink separation chamber.

13. A method of providing a priming interface to an inkjet printer having at least one inkjet printhead mounted in a printer carriage and a service zone for printhead servicing functions including printhead priming, the method comprising the steps of moving a service station carriage located within the service zone of the printer to a position which is manually accessible, sliding a manually replaceable service module having a primer port into a matching slot on the service station carriage, and pushing the service module to the end of the matching slot and thereby engaging the primer port of the service module with an external primer connector of the service station carriage.

14. A method as claimed in claim 13, including the steps of brining a printhead held within the printer carriage into sealing contact with a nozzle plate cap mounted on the service module, and priming the printhead by applying a vacuum to the printer port of the service module.

15. A method as claimed in claim 14, including the step of removing the service module from the service station carriage.

16. A service station carriage for use with an inkjet printer having at least one inkjet printhead mounted in a printer carriage and a service zone for printhead servicing functions including printhead priming, the service station carriage comprising:

at least one slot for receiving a manually replaceable service module having a primer port and means for interfacing a printhead nozzle plate to perform priming functions, and an external primer connector for engagement with the primer port of a service module.

17. A service station carriage as claimed in claim 16, wherein the primer connector is located at an end of the slot remote from the receiving end, so that the primer connector engages the primer port of the service module as said module is fully inserted in the slot.

18. A service station carriage as claimed in claim 17, wherein the service module primer port comprises an orifice and the primer connector comprises sealing means for forming a substantially air-tight seal around said orifice.

19. A service station carriage as claimed in claim 18, wherein the sealing means comprises an O-ring.

20. A service station carriage for use with an inkjet printer having at least one inkjet printhead mounted on a printer carriage and a service zone for printhead servicing functions including printhead priming, the service station carriage comprising:

at least one slot for receiving a service module having a primer port;

means for interfacing a printhead nozzle plate to perform priming functions; and a primer connector for engagement with the primer port of a service module, wherein the primer connector comprises a vent to the atmosphere for allowing the entry of air into the primer port of the service module.

21. A service station carriage for use with an inkjet printer having at least one inkjet printhead mounted on a printer carriage and a service zone for printhead servicing functions including printhead priming, the service station carriage comprising:

at least one slot for receiving a service module having a primer port;

means for interfacing a printhead nozzle plate to perform priming functions; and a primer connector for engagement with the primer port of a service module, the primer connector being located at an end of the slot remote from the receiving end, so that the primer connector engages the primer port of the service module as said module is fully inserted in the slot, and wherein the primer connector comprises an elongated member extending from a remote wall of the service station carriage, said elongated member having a reduced diameter portion at an end thereof for receiving sealing means.

22. A service station carriage as claimed in claim 21, wherein said reduced diameter portion of the elongated member further comprises a vent hole for allowing the entry of air past said sealing means and into the primer port of the service module.

23. A service station carriage as claimed in claim 22, wherein the sealing means comprises a rubber cap which is mountable on the reduced diameter portion of the elongated member.

* * * * *